US006427808B1

(12) United States Patent
Mori et al.

(10) Patent No.: US 6,427,808 B1
(45) Date of Patent: Aug. 6, 2002

(54) ELEVATOR INFORMATION COMMUNICATION SYSTEM

(75) Inventors: Akihito Mori; Hideyo Ujihara; Hiroaki Hamaji, all of Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/624,621

(22) Filed: Jul. 25, 2000

(30) Foreign Application Priority Data

Jan. 28, 2000 (JP) ..... 2000-020388

(51) Int. Cl.[7] ..... B66B 3/00
(52) U.S. Cl. ..... 187/391; 187/392; 187/393
(58) Field of Search ..... 187/281, 391–394

(56) References Cited

U.S. PATENT DOCUMENTS 5,276,295 A * 1/1994 Kameli ..... 187/392 X
5,298,695 A * 3/1994 Bahjat et al. ..... 187/392 X
5,787,020 A * 7/1998 Molliere et al. ..... 187/393 X
6,003,637 A * 12/1999 Kim et al. ..... 187/391
6,021,870 A * 2/2000 Kim ..... 187/391 X
6,269,912 B1 * 8/2001 Kim ..... 187/391 X

FOREIGN PATENT DOCUMENTS

JP 2-239078 9/1990
JP 6-87580 3/1994

* cited by examiner

*Primary Examiner*—Stanley J. Witkowski
(74) *Attorney, Agent, or Firm*—Leydig, Voit & Mayer, Ltd.

(57) ABSTRACT

An elevator information communication system in which communication cables are reduced in number with a simple configuration to make efficient communication possible at a low cost. The elevator information communication system includes a notification device arranged in the elevator system, an information input device for forming notification data for the notification device to receive, and an elevator control device connected to the notification device to output a notification command and having a relay unit connected to the information input device to relay the notification data from the information input device to the notification device.

4 Claims, 26 Drawing Sheets

FIG. 32

NOTIFICATION DATA OUTPUT RECORD

| OUTPUT DESTINATION | CONNECTION | NOTIFICATION DATA No. | CHANGE STATE |
|---|---|---|---|
| CAGE 1 | ○ | 1 | ○ |
| | | ··· | ··· |
| | | j | — |
| ⋮ | ⋮ | ⋮ | ⋮ |
| CAGE k | × | 1 | × |
| | | ··· | ··· |
| | | j | — |
| ENTRANCE 1 | ○ | 1 | ○ |
| | | ··· | ··· |
| | | j | ○ |
| ⋮ | ⋮ | ⋮ | ⋮ |
| ENTRANCE l | × | 1 | × |
| | | ··· | ··· |
| | | j | — |
| ⋮ | ⋮ | ⋮ | ⋮ |
| ENTRANCE m | × | 1 | × |
| | | ··· | ··· |
| | | j | — |

[BEFORE ENTRANCE NOTIFICATION DEVICE 1 IS INSTALLED]

→

NOTIFICATION DATA OUTPUT RECORD

| OUTPUT DESTINATION | CONNECTION | NOTIFICATION DATA No. | CHANGE STATE |
|---|---|---|---|
| CAGE 1 | ○ | 1 | ○ |
| | | ··· | ··· |
| | | j | — |
| ⋮ | ⋮ | ⋮ | ⋮ |
| CAGE k | × | 1 | × |
| | | ··· | ··· |
| | | j | — |
| ENTRANCE 1 | ○ | 1 | ○ |
| | | ··· | ··· |
| | | j | ○ |
| ⋮ | ⋮ | ⋮ | ⋮ |
| ENTRANCE l | ○ | 1 | ○ |
| | | ··· | ··· |
| | | j | — |
| ⋮ | ⋮ | ⋮ | ⋮ |
| ENTRANCE m | × | 1 | × |
| | | ··· | ··· |
| | | j | — |

[AFTER ENTRANCE NOTIFICATION DEVICE 1 IS INSTALLED]

ELEVATOR INFORMATION COMMUNICATION SYSTEM

BACKGROUND OF THE INVENTION

1. Field of the Invention

The present invention relates to an elevator information communication system for notifying an elevator entrance or the cage of an elevator of information.

2. Description of the related art

In general, in an elevator information communication system, two types of data are communicated. One of them is information-system data communication of notification data such as a message, and the other is control-system data for communicating a notification command for selecting notification data depending on the state of an elevator to supply the notification data at a good timing. Since the information-system data includes a message or the like, the information-system data is large in amount, and the time required to change the information-system data may be relatively long. The control-system data consists of predetermined code data or the like. The control-system data is small in amount, and the control-system data is allowed to be delayed slightly.

For this reason, in a conventional elevator information communication system, two types of cables, i.e., a control-system data communication cable and an information-system data communication cable extending to an elevator entrance or the cage of an elevator are arranged according to data which are different in quality, and the different data are communicated through these cables.

A conventional elevator information communication system will be described below with reference to FIG. 33 and FIGS. 34A and 34B. FIG. 33 is a block diagram showing the entire configuration of the elevator information communication system, and FIGS. 34A and 34B are time charts of communication path data of a control-system cable 6 and an information-system cable 5 of the conventional elevator information communication system. Here, an information input device 1 is constituted by a notebook computer or the like. Data can be input with a keyboard or the like (e.g., a CE connects the personal computer to the information-system cable 5 to perform updating or the like of notification data).

In FIG. 33, notification data 200 input by the information input device 1 is input to notification devices 3-1 to 3-n through the information cable system 5 and stored by storage means 31-1 to 31-n. In FIG. 34B, the notification data 200 consists of a selector 210 for selecting the notification devices 3-1 to 3-n, a command 220 for message updating, time correction, and the like, and data 230. The data 230 in message updating consists of a message number 231, a text length 232, and text data 233. A serial communication scheme using a start-stop transmission scheme is used as a communication scheme to add BCC data or the like for checking the rationality of communication data.

With respect to a notification command, for example, it is assumed that a message number 3 is defined as a crowded condition notification (corresponding to the message number 231 and the concrete example thereof), an elevator control device 2 detects a crowded condition to output a notification command 100 in which the selector 101, the command 102, and the data 103 are defined as the notification device 3-1 of the cage, a message display, and the message number 3, respectively. This notification command 100 is input to the notification devices 3-1 to 3-n through the control-system cable 6. Since the notification device 3-1 of the cage is defined as the selector 101, the message of the message number 3 is displayed by a display means 32-1. On the other hand, the notification command 100 is also input to the notification devices 3-2 to 3-n of the elevator entrance. However, since each of the notification devices 3-2 to 3-n do not correspond to the selector 101, the notification devices 3-2 to 3-n neglect the notification command 100 and do not perform any operation.

Here, when the information input device 1 and each of the notification devices 3-1 to 3-n are connected to each other at a ratio of !: !, the selector 210 is not necessary, and each of the notification devices 3-1 to 3-n returns a reply representing whether reception is normally performed. Data is generally re-output from the information input device 1 to the notification devices 3-1 to 3-n in which reception is not normally performed. However, in the configuration in FIG. 33, when replies are given by the notification devices 3-1 to 3-n, a plurality of replies conflict with each other. For this reason, the replies cannot be identified by the information input device 1.

In the conflict of replies, a method of changing the response timings of the notification devices 3-1 to 3-n from each other or a method of selecting one of the notification devices 3-1 to 3-n from the information input device 1 to check them may be used. However, a cumbersome setting must be performed, and a long communication time is disadvantageously required. For this reason, the replies from the notification devices 3-1 to 3-n are eliminated, and data is repeatedly output from the information input device 1 twice, so that the reliability is assured.

An example of the system in which a serial transmission cable in an elevator way is eliminated will be introduced. As described in Japanese Unexamined Patent Application Publication No. 6-87580, a packet transmission control device is installed, notification data from an information input device is stored in the packet transmission control device, and the notification data is transmitted from the packet transmission control device to a notification device when the operation of the elevator is idle. As described in Japanese Patent No. 2700404, fixed information is transmitted as the first series of data, and a block of arbitrary information divided into a plurality of fixed-length blocks is transmitted as the second series of data.

In the conventional elevator information communication system, an information-system cable for transmitting a large amount of notification data such as image data, character data, and audio data and a control-system cable for transmitting a notification command having a small amount of data must be installed in the elevator way. For this reason, the system is very expensive, disadvantageously. In order to output notification data from the information input device to each notification device, the notification data must be repeatedly output twice in vain although transmission error rate is very low.

The scheme described in Japanese Unexamined Patent Publication No. 6-87580 is expensive because a packet transmission control device must be additionally installed, and disadvantageously requires a long time to input notification data output from an information input device to notification devices. In a scheme in Japanese Patent No. 2700404, a notification command and notification data are transmitted in a fixed length. For this reason, even if the notification command is not required to be output, the notification data cannot be efficiently transmitted.

SUMMARY OF THE INVENTION

The present invention has been made to solve the above problems, and has as its object to obtain an elevator information communication system in which the number of communication cables can be reduced with a simple configuration without arranging a dedicated device such as a packet transmission control device to efficiently perform communication at a low cost.

In consideration of the object, according to the first aspect of the present invention, there is provided an elevator information communication system including a notification device arranged in the elevator system, an information input device for forming notification data to the notification device to input the notification data, and an elevator control device connected to the notification device to output a notification command and having relay means connected to the information input device to relay the notification data input from the information input device to the notification device.

According to the second aspect of the present invention, there is provided an elevator information communication system according to the first aspect wherein the elevator control device includes switching means for adding non-transmission time and identification data to data and outputting the data in order to identify a notification command from the elevator control device and the notification data from the information input device by the information device.

According to the third aspect of the present invention, there is provided an elevator information communication system according to the first or second aspect wherein the elevator device includes command means for, when a notification command is generated during outputting of notification data from the information input means, interrupting the outputting of the notification data.

According to the fourth aspect of the present invention, there is provided an elevator information communication system according to one of the first to third aspects wherein the elevator control device changes notification data into a packet to output the packet, and the notification device includes restoration means for restoring interrupted notification data into original notification data.

According to the fifth aspect of the present invention, there is provided an elevator information communication system according to one of the first to fourth aspects wherein the notification device includes reply means for generating a resending request when input notification data is abnormal, and the information input device includes resending means for resending the notification data according to the resending request.

According to the sixth aspect of the present invention, there is provided an elevator information communication system according to one of the first to fifth aspects wherein the information input device includes scanning means for checking a notification device which is powered off and broken, and the notification device includes response means for making a check response to the check.

According to the seventh aspect of the present invention, there is provided an elevator information communication system according to the sixth aspect wherein the information input device detects the notification device added by the scanning means, and includes re-output means for further outputting un-output notification data to set necessary notification data in the added notification device.

According to the eighth aspect of the present invention, there is provided an elevator information communication system including a notification device arranged in the elevator system, an elevator control device connected to the notification device to output a notification command, and an information input device connected to the notification device to form notification data for the notification device and to input the notification, wherein the notification device includes relay means for generating a resending request when the input notification data is abnormal, and the information input device includes resending means for resending the notification data according to the resending request.

According to the ninth aspect of the present invention, there is provided an elevator information communication system according to the eighth aspect wherein the information input device includes scanning means for checking a notification device which is powered off and broken, and the notification device includes response means for making a check response to the check.

According to the tenth aspect of the present invention, there is provided an elevator information communication system wherein the information input device detects the notification device added by the scanning means, and includes re-output means for further outputting un-output notification data to set necessary notification data in the added notification device.

BRIEF DESCRIPTION OF THE DRAWINGS

FIG. 32 shows tables of notification data output records of the information input device according to seventh embodiment of the present invention.

DETAILED DESCRIPTION OF THE PREFERRED EMBODIMENTS

First Embodiment

Figure 1:
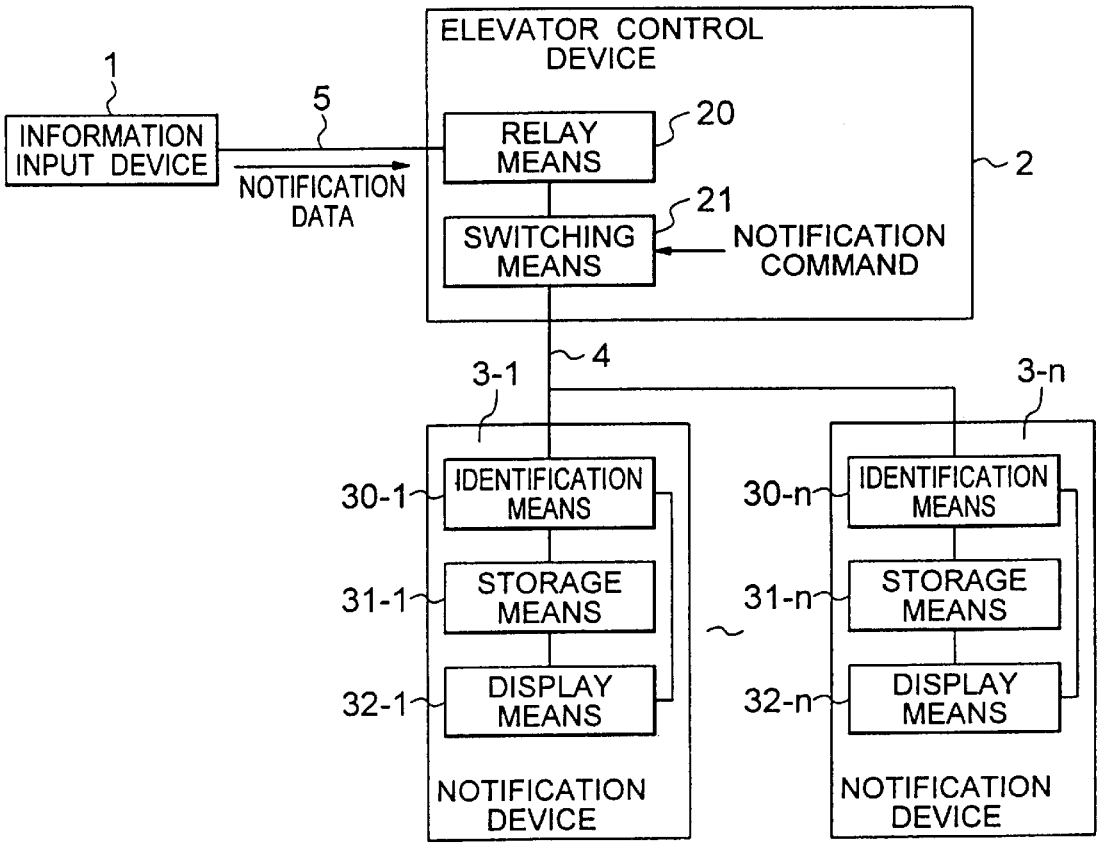
FIG. 1 is a block diagram showing the entire configuration of an elevator information communication system according to first and second embodiments of the present invention.
Figure 2:
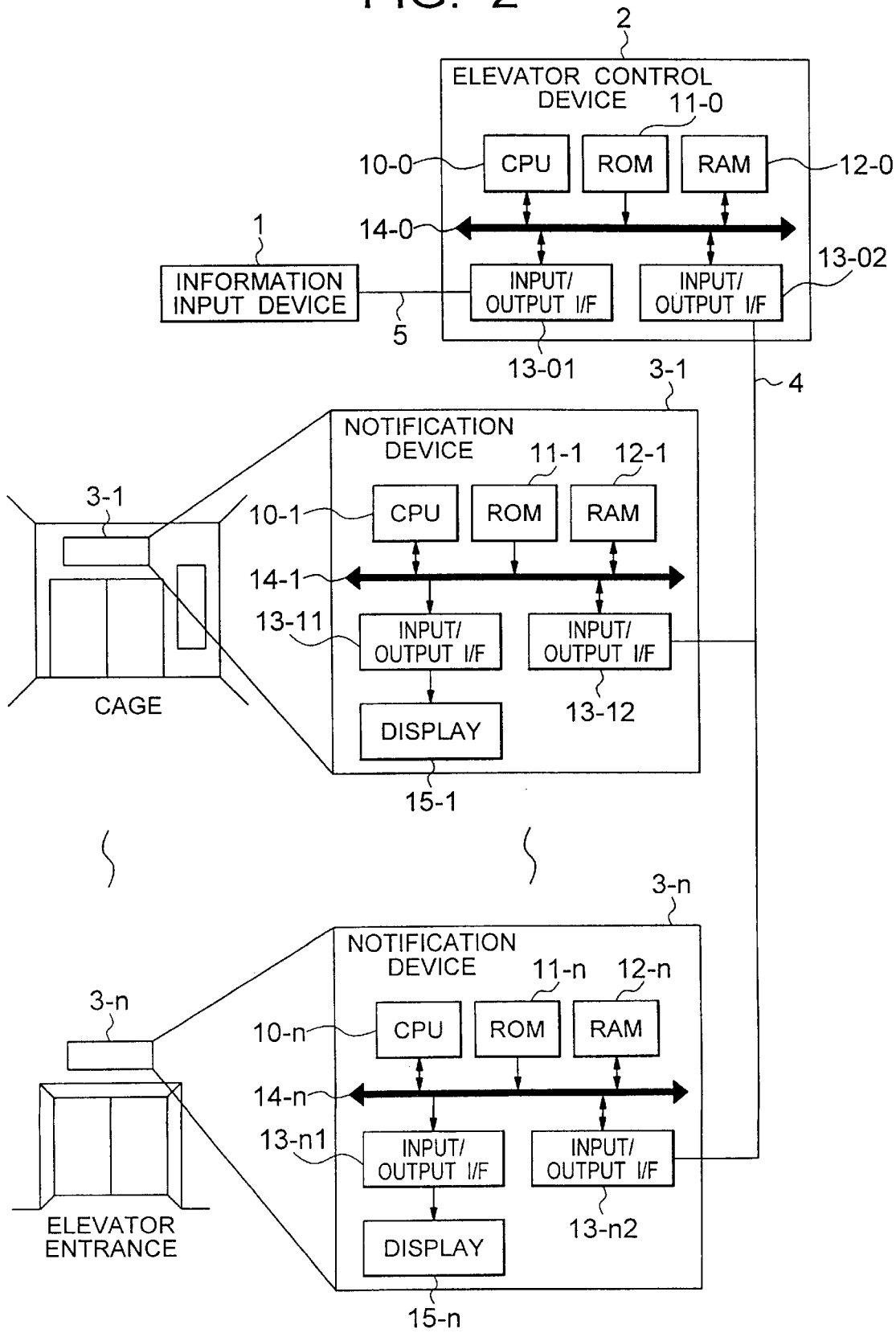
FIG. 2 is a block diagram showing the hardware configuration of an elevator information communication system according to first, second, third, and fourth embodiments of the present invention.
Figure 3:
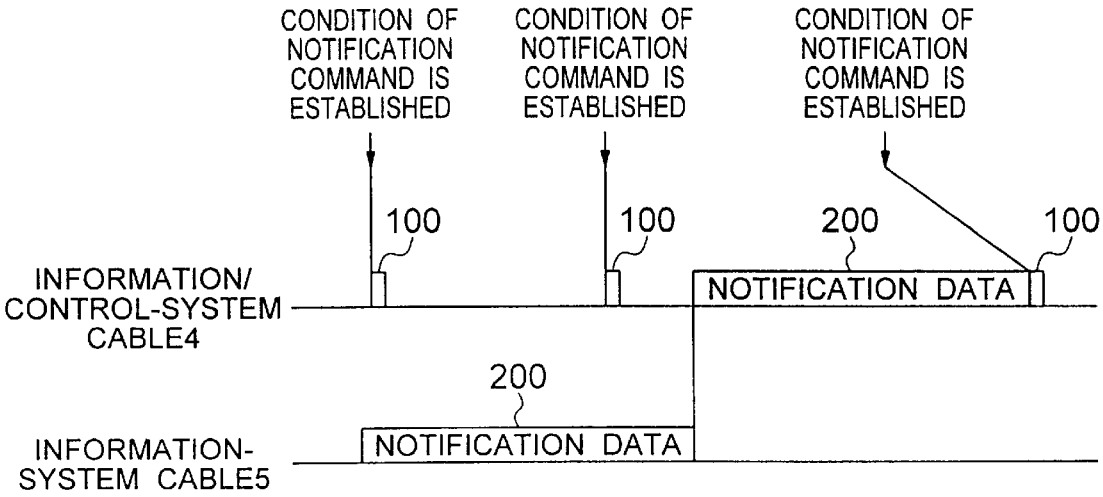
FIG. 3 is a time chart of communication path data of the elevator information communication system according to first embodiment of the present invention.
Figure 4:
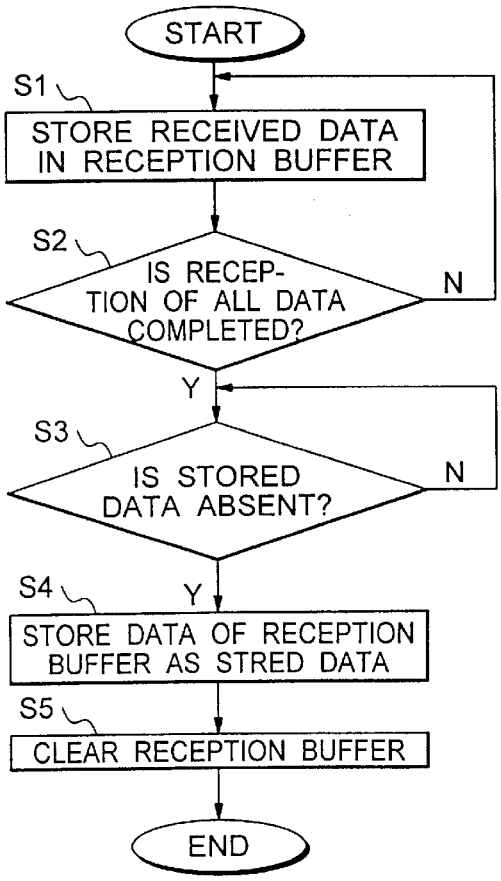
FIG. 4 is a flow chart showing the operation of a relay means of an elevator control device according to first, second, and third embodiments of the present invention.
Figure 5:
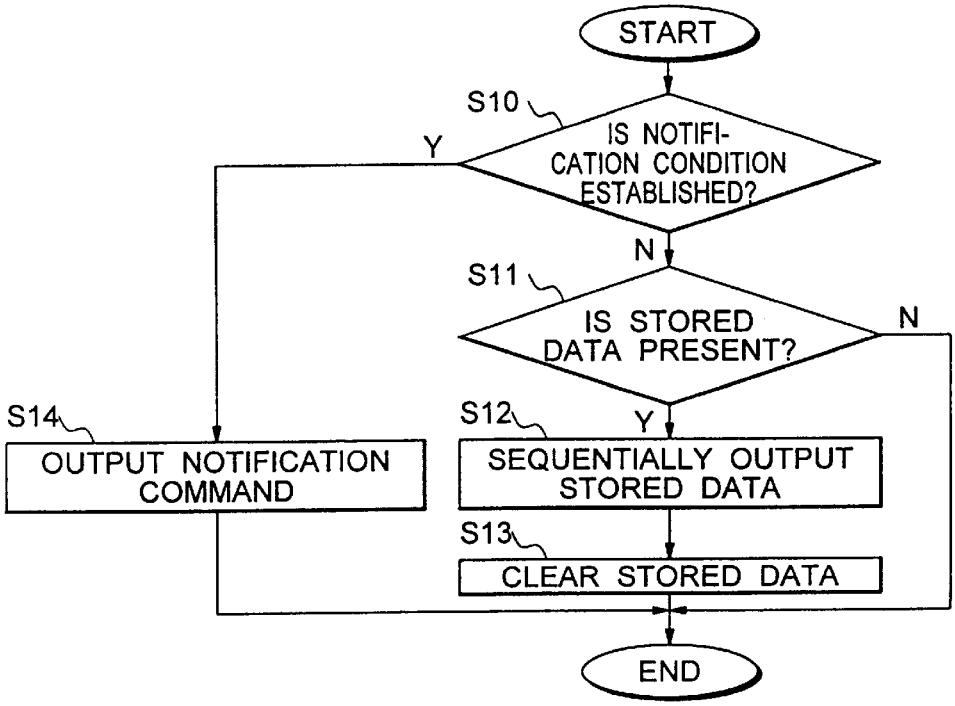
FIG. 5 is a flow chart showing the operation of a switching means of the elevator control device according to first embodiment of the present invention.
Figure 6:
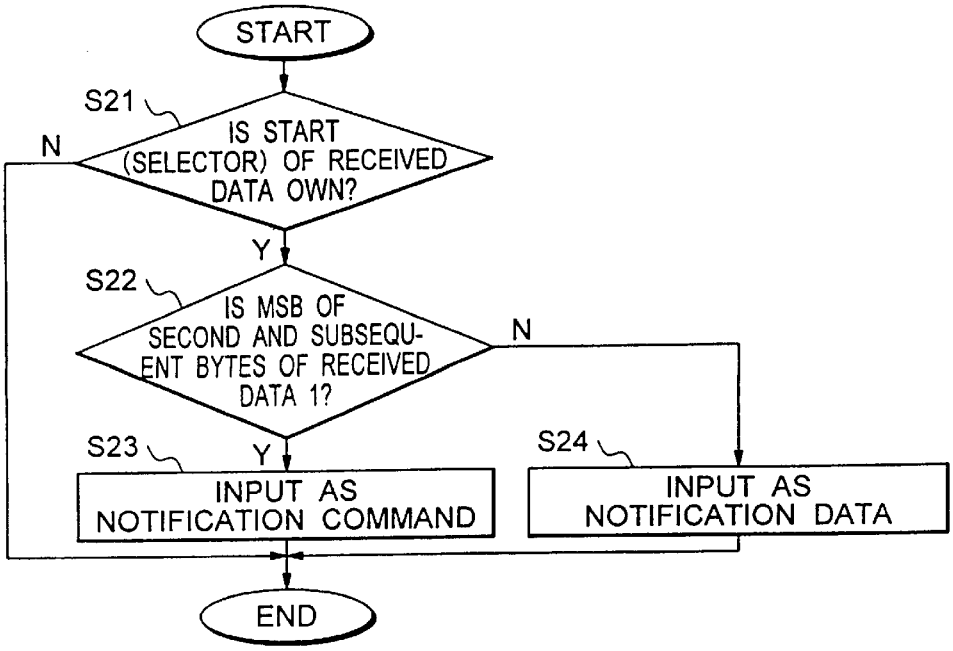
FIG. 6 is a flow chart showing the operation of a identification means of a notification device according to first and third embodiments of the present invention.

First embodiment of the present invention will be described below with reference to FIGS. 1 to 6. FIG. 1 is a block diagram showing the entire configuration of an elevator information communication system, FIG. 2 is a block diagram showing the hardware configuration of the system, and FIG. 3 is a time chart of communication path data. FIGS. 4, 5, and 6 are flow charts showing the operations in a relay means 20 and a switching means 21 of an elevator control device 2 and an operation in identification means 30-1 to 30-n of the notification devices 3-1 to 3-n, respectively.

In first embodiment, a 7-bit coding system in which the MSBs (most significant bits) are used as identifiers of a notification command 100 and notification data 200 is used. MBS=1 is satisfied in the notification command 100, and MBS=0 is satisfied in the notification data 200. The same reference numerals as in the conventional configuration denote the same parts in the configuration of First embodiment.

In FIG. 2, CPUs 10-0 to 10-n are central processing units, ROMs 11-0 to 11-n are read-only memories in which programs are stored, and RAMs 12-0 to 12-n are programmable memories in which operation results or the like are temporarily stored. Input/output I/Fs 13-01 to 13-n2 are input/output interfaces for performing voltage level conversion, analog/digital conversion, serial/parallel conversion, and the like, buses 14-0 to 14-n are bus (signal lines) groups such as control buses, address buses, and data buses, and displays 15-1 to 15-n are displays for displaying information.

Figures 34A, 34B:
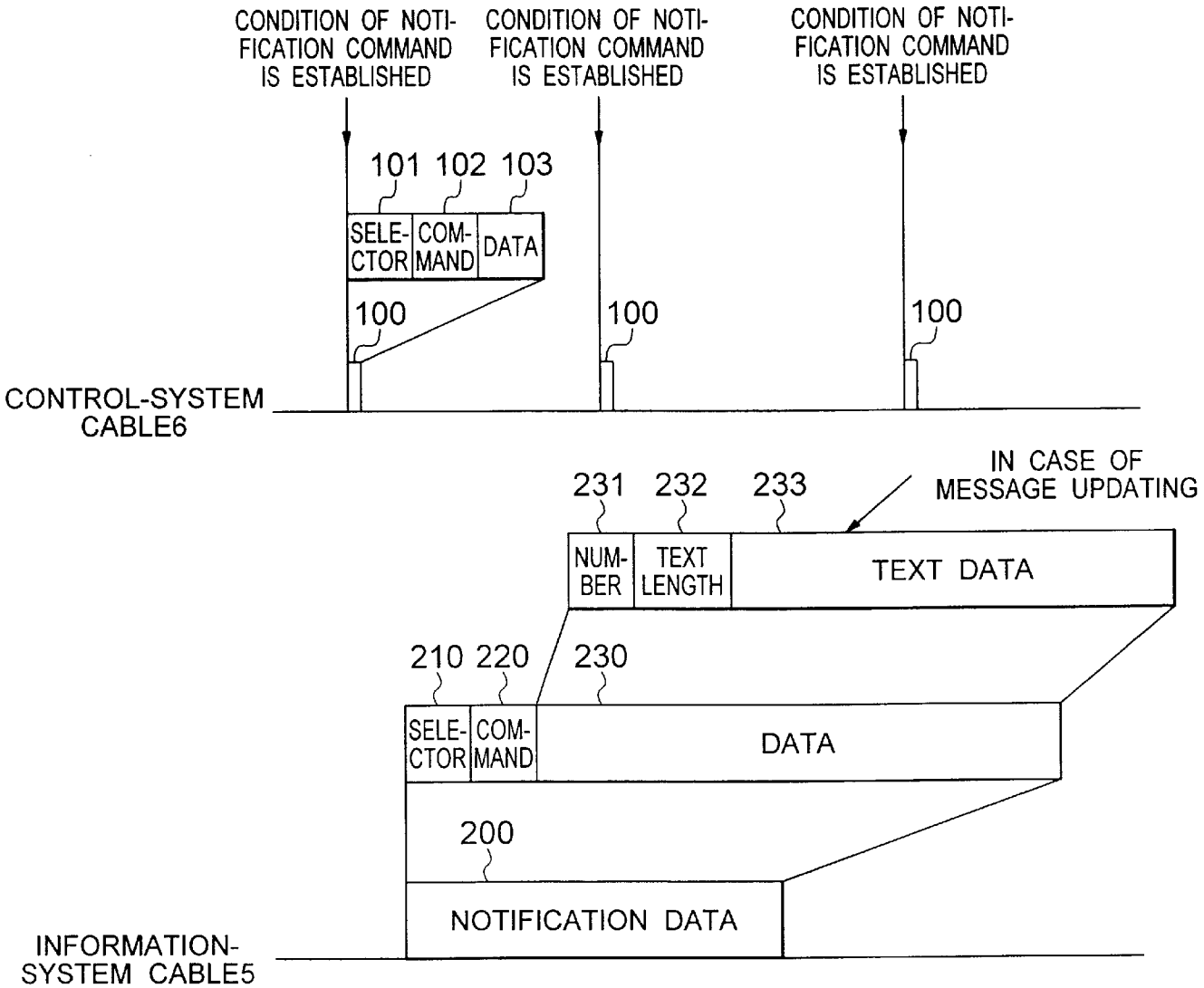
FIGS. 34A and 34B are time charts of communication path data of the conventional elevator information communication system.

An operation performed when a notification command is transmitted will be described below. When the elevator control device 2 detects a crowded condition (notification condition for a cage, and message number is set to be 3), in FIG. 1, the notification command 100 representing "selector 101=cage, command 102=message display, data 103=3" (see FIG. 34) is given to the switching means 21. In S10 in FIG. 5, the notification condition is established (Yes is set), the notification command 100 is output in step S14. The notification command 100 is input to the notification devices 3-1 to 3-n through the input/output I/F 13-02, an information/control-system cable 4, and the input/output I/Fs 13-12 to 13-n2 shown in FIG. 2 and then input to the identification means 30-1 to 30-n in FIG. 1.

In the identification means 30-1 of the notification device 3-1 in the cage, the start selector of received data is for the identification means 30-1 in Step 21 in FIG. 6, and the MSBs of the second and subsequent bytes are checked to determine if they are 1 and, if so, Yes is set in step S22 in FIG. 6. For this reason, "command 1-2=message display, data 103=3" of the second and subsequent bytes is input as a notification command in step S23. This notification command is given to the display means 32-1 in FIG. 1 to display "crowded" on the display 15-1 (see FIG. 2). Although the notification devices 3-1 to 3-n of the elevator entrance receive the same notification command 100, the selector of the received data is not for the notification devices 3-2 to 3-n in step S21 of FIG. 6 (No is determined in step S21). For this reason, N (No) is determined in step S21, so that the notification devices 3-2 to 3-n neglect the notification command 100 without any operation.

An operation performed when notification data is transmitted will be described below. A case in which the message number 3 of the notification device 3-1 of the cage is changed into "A parson who lately got into, please get out of the cage" will be described below. In FIG. 1, notification data 200 representing "selector 210=cage, command 220= message updating, number 231=3, text length 232=15 characters, text data 233=A person who lately got into, please get out of the cage" (see FIG. 34) is given to the relay means 20 of the elevator control device 2.

In the relay means 20, the received data is stored in a reception buffer (not especially shown) in step S1 in FIG. 4, and the completion of reception of all data is checked by the text length or the like in step S2. Upon completion of reception of all the data, the presence/absence of stored data is checked instep S3. If there is no stored data, the data of the reception buffer is stored as stored data in a memory (not especially shown) in step S4, and the reception buffer is cleared in step S5.

In the switching means 21, since a notification condition is not established (N is set) in step S10 in FIG. 5, and stored data are present (Y is set) in step S11, the stored data are sequentially output in step S12. Upon completion of the outputting, the stored data are cleared in step S13. In FIG. 2, the stored data (=notification data) output is input to the notification devices 3-1 to 3-n through the input/output I/F 13-02, the information/control-system cable 4, and the input/output I/Fs 13-12 to 13-n2. As in the notification command 100 described above, in the notification device 3-1 of the cage, in FIG. 6, Yes is determined in step S21, No is determined in step S22, and the received data is input as notification data in step S24.

FIG. 3 shows the manner of the notification command 100 and the notification data 200 which flow on the information/control-system cable 4. If the condition of the notification command is not established in the elevator control device 2 until after all the notification data from the information input device 1 are stored, the notification data is output before the notification command. When a notification command is generated during the output of the notification data, the notification command is output immediately after the notification data are output.

As described above, in the elevator information communication system according to this embodiment, notification data transmitted from the information input device to the notification device is relayed by the relay means arranged in. the elevator control device, so that a dedicated information-system cable for connecting the information input device and the notification device to each other can be omitted.

Second Embodiment

Figure 7:
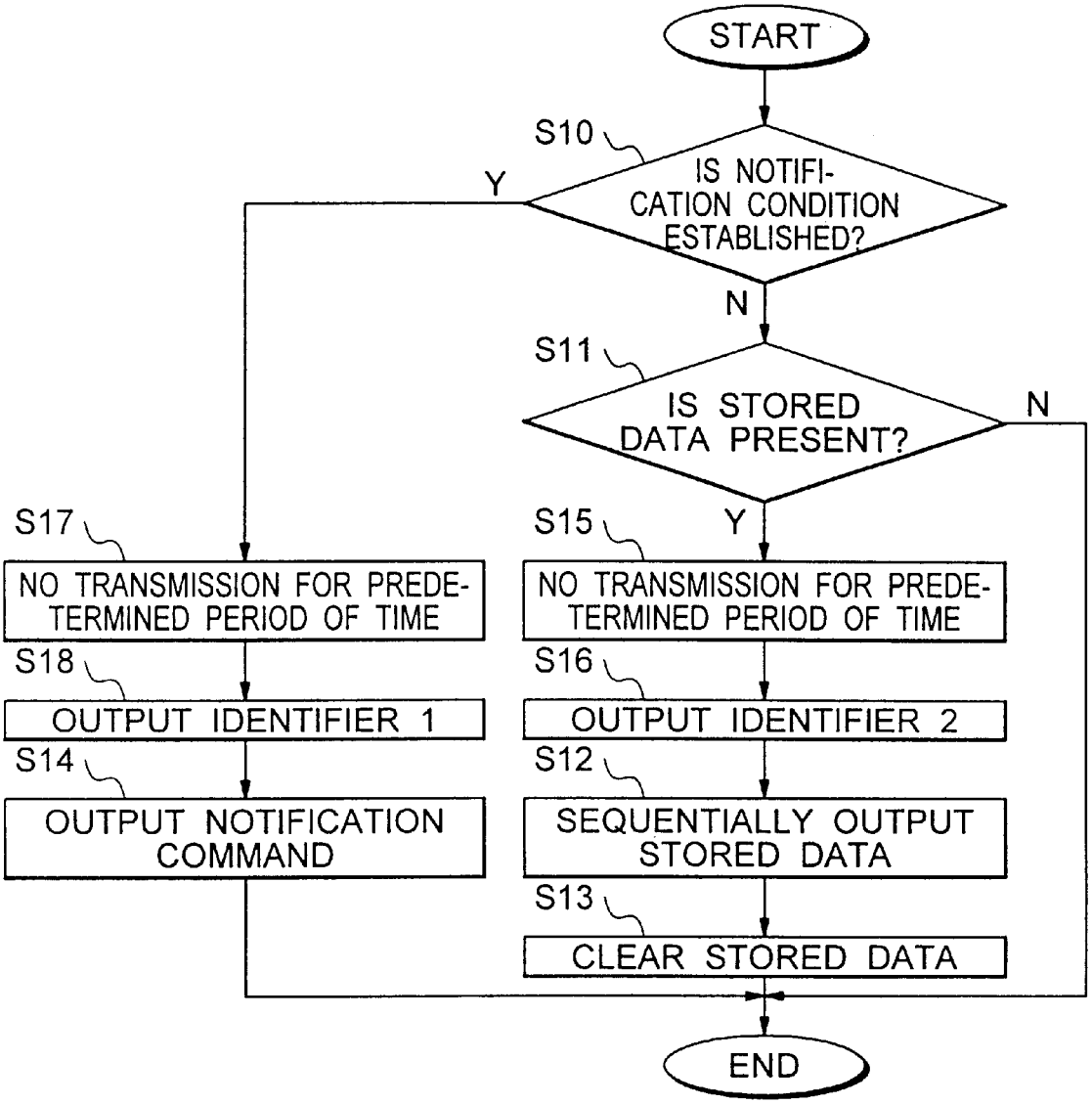
FIG. 7 is a flow chart showing the operation of a switching means of the elevator control device according to second embodiment of the present invention.
Figure 8:
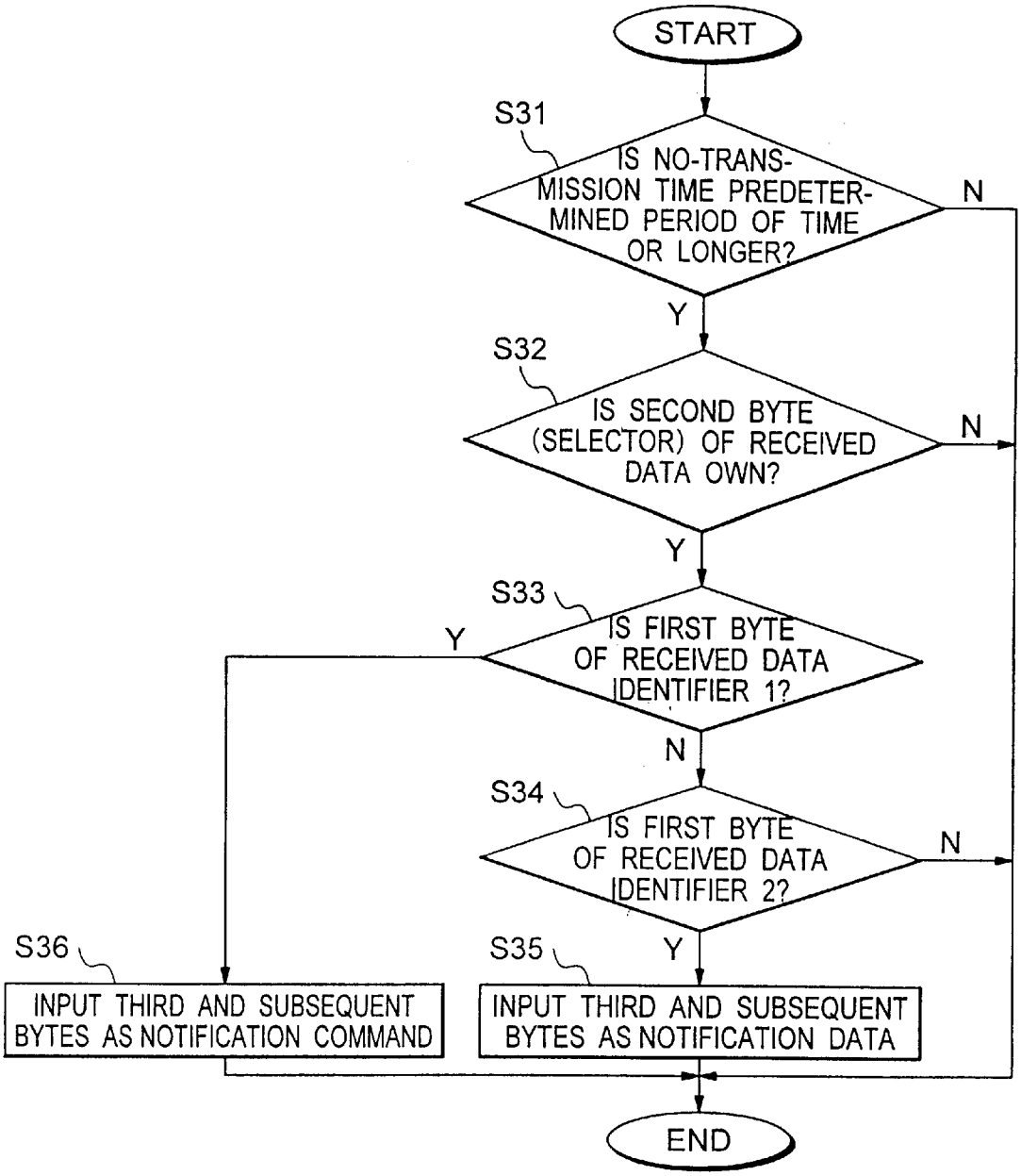
FIG. 8 is a flow chart showing the operation of a identification means of a notification device according to second embodiment of the present invention.

Second embodiment of the present invention will be described below with reference to FIGS. 1, 2, 4, 7, and 8. FIG. 7 is a flow chart showing the operation of a switching means 21 of an elevator control device 2. FIG. 8 is a flow chart showing the operation of identification means 30-1 to 30-n of notification devices 3-1 to 3-n.

When the elevator control device 2 detects a crowded condition (notification condition for a cage, and message number is set to be 3), in FIG. 1, the notification command representing "selector 101=cage, command 102=message display, data 103=3" is given to the switching means 21. In the switching means 21, the notification condition is established in step S10 in FIG. 7, no transmission for a predetermined period of time is determined in step S17, identifier 1 is output in step S18, and a notification command 100 is output in step S14.

The notification command 100 is input to notification devices 3-1 to 3-n through an input/output I/F 13-02, an information/control-system cable 4, and input/output I/Fs 13-12 to 13-n2 and then input to the identification means 30-1 to 30-n in FIG. 1.

In the identification means 30-1 of the notification device 3-1 of the cage, in FIG. 8, a period of no-transmission time is a predetermined period of time or longer in step S31, the selector of the second byte is of the identification means 30-1 in step S32, and the first byte is identifier 1 (Y is set) in step S33. For this reason, "command 102=message display, data 103=3" of the third and subsequent bytes is input as a notification command in step S36. This notification-command is given to the display means 32-1 in FIG. 1, "crowded" is displayed on a display 15-1 (see FIG. 2). Although the notification devices 3-2 to 3-n of the elevator entrance receive the same notification command 100, the selector of the received data is not of the notification devices 3-2 to 3-n in step S32 in FIG. 8 (No is determined in step S32). For this reason, the notification devices 3-2 to 3-n neglect the notification command 100 without any operation.

A case in which the message number 3 of the notification device 3-1 of the cage is changed into "A person who lately got into, please get out of the cage" will be described below. In FIG. 1, notification data 200 representing "selector 210 cage, command 220=message updating, number 231=3, text length 232=15 characters, text data 233=A person who lately got into, please get out of the cage" (see FIG. 34) is given to the relay means 20 of the elevator control device 2.

In the relay means 20, the received data is stored in a reception buffer in step S1 in FIG. 4, and the completion of reception of all data is checked by the text length or the like in step S2. Upon completion of reception of all the data, the presence/absence of stored data is checked in step S3. If there is no stored data, the data of the reception buffer is stored as stored data in a memory in step S4, and the reception buffer 1 is cleared in step S5.

In the switching means 21, since a notification condition is not established (N is set) in step S10 in FIG. 7, and stored data are present (Y is set) in step S11, no transmission for a predetermined period of time is determined in step S15. Identifier 2 is output in step S16, the stored data are sequentially output in step S12. Upon completion of the outputting, the stored data are cleared in step S13. In FIG. 2, the stored data (=notification data) output is input to the notification devices 3-1 to 3-n through the input/output I/F 13-02, the information/control-system cable 4, and the input/output I/Fs 13-12 to 13-n2. As in the notification command 100 described above, in the notification device 3-1 of the cage, in FIG. 8, Yes is determined in step S32, No is determined in step S32, Yes is determined in step S34, and the received data is input as notification data in step S35.

In the elevator information communication system according to this embodiment, in order to perform a switching operation between a notification command and notification data which are transmitted from the elevator control device to the notification device, a period of no-transmission time and identification data are added. For this reason, both the notification command and the notification data can be easily identified.

Third Embodiment

Figure 9:
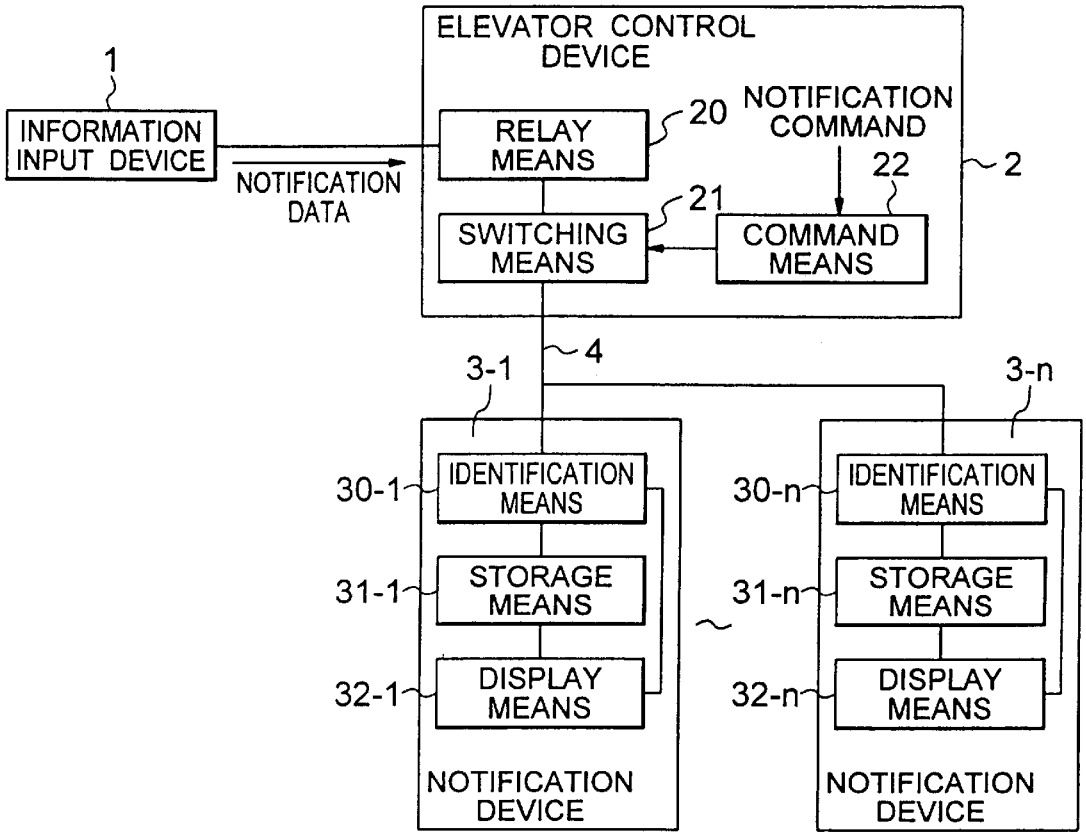
FIG. 9 is a block diagram showing the entire configuration of an elevator information communication system according to third embodiment of the present invention.
Figure 10:
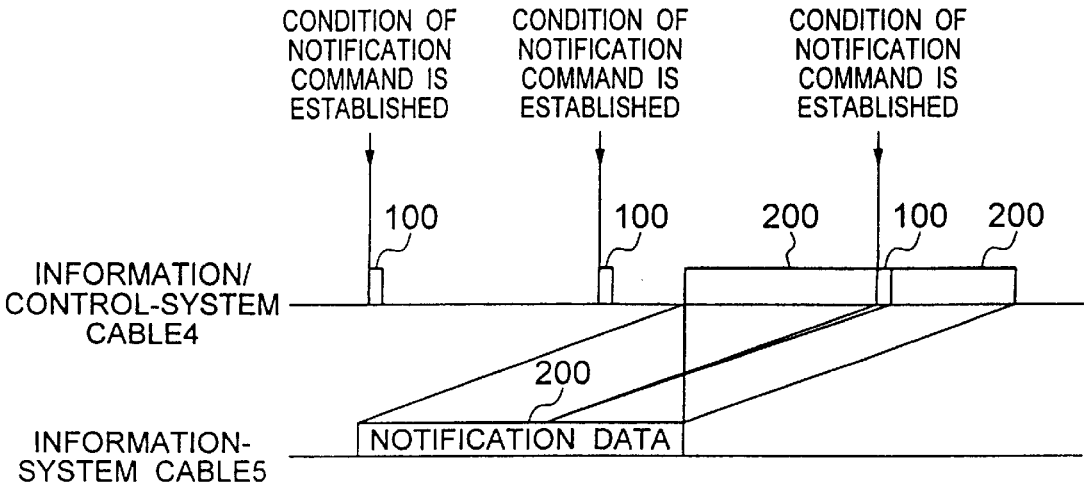
FIG. 10 is a time chart of communication path data of the elevator information communication system according to third embodiment of the present invention.
Figure 11:
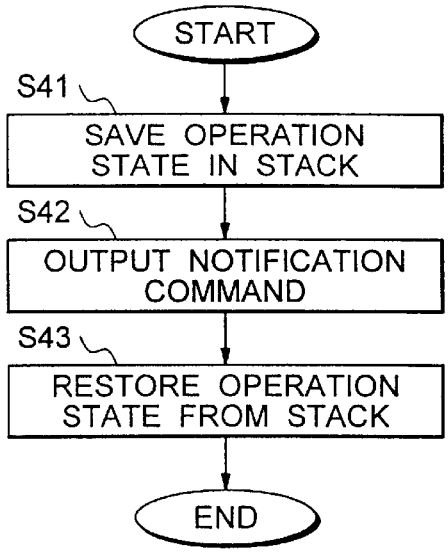
FIG. 11 is a flow chart showing the operation of a command means of an elevator control device according to third embodiment of the present invention.
Figure 12:
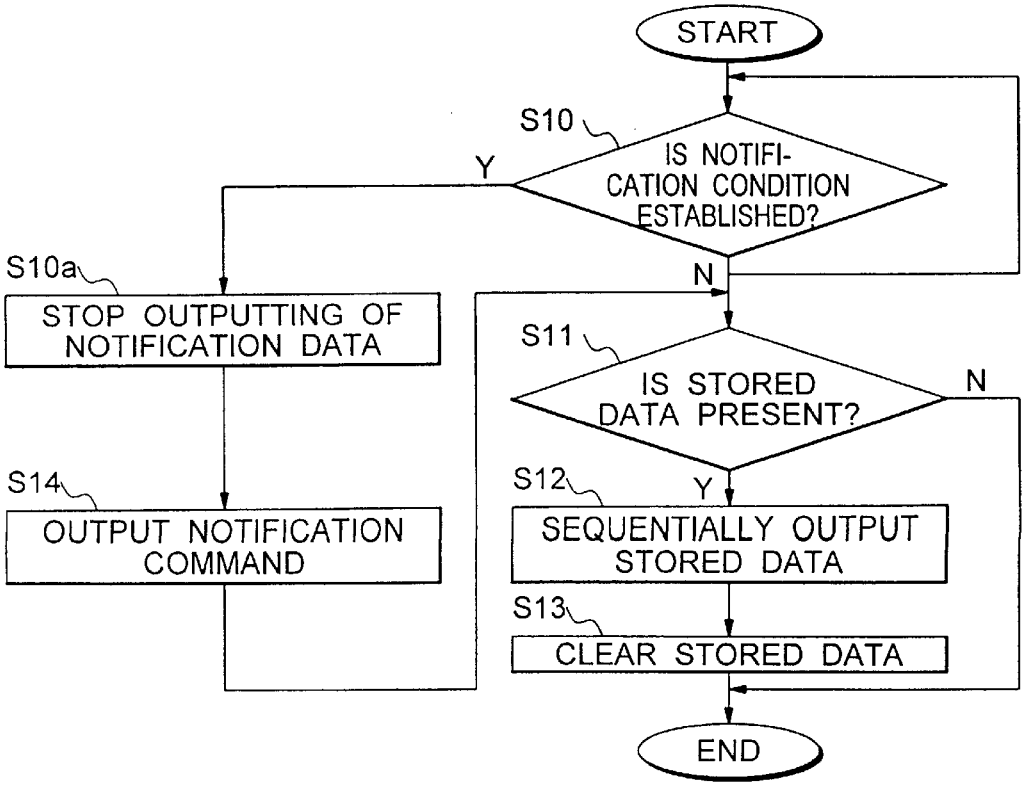
FIG. 12 is a flow chart showing the operation of a switching means of the elevator control device according to third embodiment of the present invention.

Third embodiment of the present invention will be described below with reference to FIGS. 2, 4, 6, 9 to 12. FIG. 9 is a block diagram showing the entire configuration of an elevator information communication system, FIG. 10 is a time chart of communication path data, and FIGS. 11 and 12 are flow charts showing operations of a command means 22 and a switching means 21 of an elevator control device 2. In third embodiment, a 7-bit coding system in which the MSBs (most significant bits) are used as identifiers of a notification command 100 and notification data 200 is used. MBS=1 is satisfied in the notification command 100, and MBS=0 is satisfied in the notification data 200.

When the elevator control device 2 detects a crowded condition (notification condition for a cage, and message number is set to be 3), in FIG. 9, the notification command 100 representing "selector 101=cage, command 102= message display, data 103=3" (see FIG. 34) is given to the command means 22. When the notification command 100 is given to the command means 22, interruption is made to save the present operation state in a stack in step S41 in FIG. 11, a notification command is output in step S42, and the original operation state is restored from the stack in step S43.

In this manner, in the switching means 21, when the notification condition is satisfied while the notification data 200 is being output in step S10 in FIG. 12, and the outputting of the notification data 200 is stopped in step S10*a*. An interruption process for the command means 22 in FIG. 11 is performed in step S14, and the subsequent notification data 200 are output.

The scheme for performing interruption by establishing the notification condition has been described above. However, a multi-task configuration in which the task of the command means 22 takes priority over the task of the switching means 21 may be used.

The notification command 100 is input to the notification devices 3-1 to 3-n through the input/output I/F 13-02, the information/control-system cable 4, and the input/output I/Fs 13-12 to 13-n2 which are shown in FIG. 2, and input to the identification means 30-1 to 30-n in FIG. 9.

In the identification means 30-1 of the notification device 3-1 of the cage, since Yes is set in each of steps S21 and S22 in FIG. 6, "command 102=message display, data 103=3" of the second and subsequent bytes is input as a notification command in step S23. This notification command is given to the display means 32-1 in FIG. 9, "crowded" is displayed on a display 15-1.

The notification devices 3-2 to 3-n of the elevator entrance receive the same notification command 100. However, N is determined in step S21 in FIG. 6, the notification devices 3-2 to 3-n neglect the notification command 100 without any operation.

A case in which the message number 3 of the notification device 3-1 of the cage is changed into "A person who lately got into, please get out of the cage" will be described below. In FIG. 9, notification data 200 representing "selector 210= cage, command 220=message updating, number 231=3, text length 232=15 characters, text data 233=A person who lately got into, please get out of the cage" (see FIG. 34) is given to the relay means 20 of the elevator control device 2.

In the relay means 20, the received data is stored in a reception buffer in step S1 in FIG. 4, and the completion of reception of all data is checked by the text length or the like in step S2. Upon completion of reception of all the data, the presence/absence of stored data is checked in step S3. If there is no stored data, the data of the reception buffer is stored in a memory in step S4, and the reception buffer is cleared in step S5.

In the switching means 21, since Y is determined in step S11 when the notification condition is not established in step S10 in FIG. 12., stored data are sequentially output in step S12. Upon completion of the outputting, the stored data are cleared in step S13. In FIG. 2, the stored data (=notification data) output is input to the notification devices 3-1 to 3-n through the input/output I/F 13-02, the information/control-system cable 4, and the input/output I/Fs 13-12 to 13-n2. As in the notification command 100 described above, in FIG. 6, when Yes is determined in step S21, and N is determined in step S22, the received data is input as notification data in step S24.

FIG. 10 shows the manner of the notification command 100 and the notification data 200 which flow on the information/control-system cable 4. In FIG. 3 of the first embodiment, in the elevator control device 2, if the condition of the notification command is not satisfied after all notification data from the information input device 1 are stored, the notification data are output. Once the notification data begin to be output, even if a notification command is received, the notification command temporarily waits until the outputting of the notification data is finished. In this third embodiment, as shown in FIG. 10, the notification data 200 in interrupted and the notification command 100 is output.

As described above, in the elevator information communication system according to this embodiment, when a notification command is present while notification data is being output from the elevator control device, the outputting of the notification data is stopped by the command means to output a notification command. For this reason, outputting of the notification command can be prevented being delayed.

Fourth Embodiment

Figure 13:
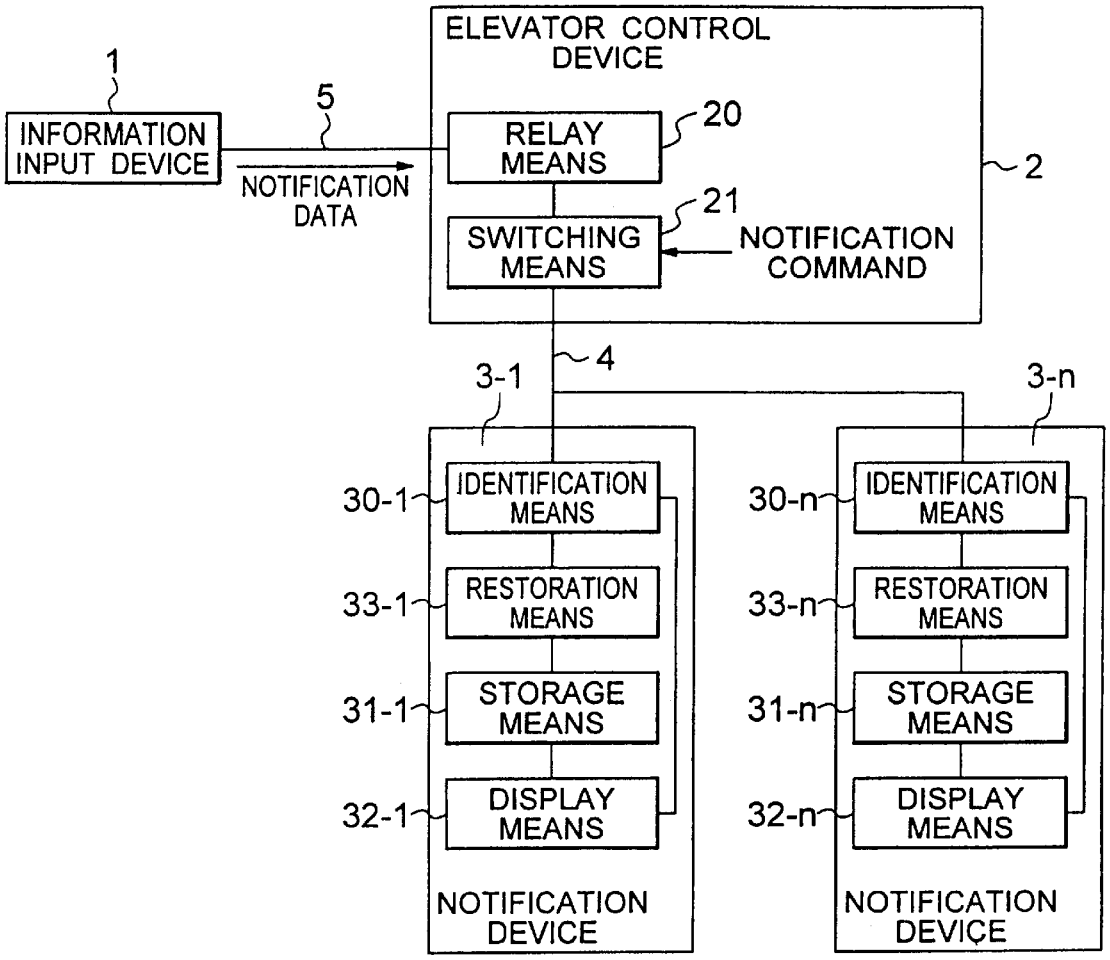
FIG. 13 is a block diagram showing the entire configuration of an elevator information communication system according to fourth embodiment of the present invention.
Figure 14:
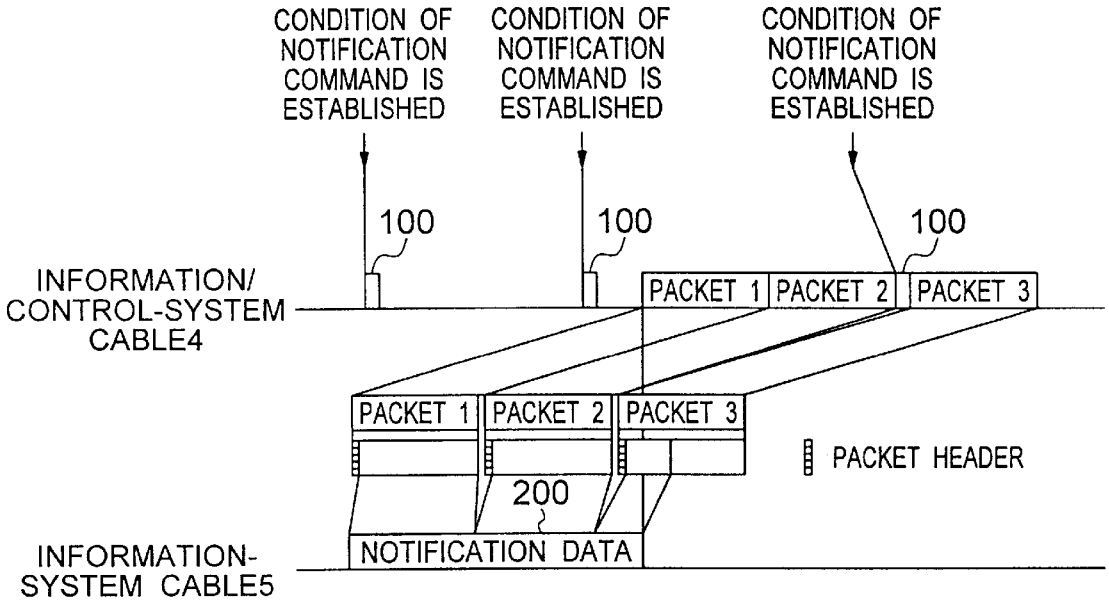
FIG. 14 is a time chart of communication path data of the elevator information communication system according to fourth embodiment of the present invention.

A fourth embodiment of the present invention will be described below with reference to FIGS. 2 and 13 to 18. FIG. 13 is a block diagram showing the entire configuration of an elevator information communication system, and FIG. 14 is a time chart of a communication path of data. FIG. 14 shows the notification data 200 divided into three packets. FIGS. 15, 16, 17, and 18 are flow charts showing the operations of a relay means 20 and a switching means 21 of an elevator control device 2 and the operations of identification means 30-1 to 30-n and restoration means 33-1 to 33-n of notification devices 3-1 to 3-n.

When the elevator control device 2 detects a crowded condition (notification condition for a cage, and message number is set to be 3), in FIG. 13, the notification command 100 representing "selector 101=cage, command 102= message display, data 103=3" is given to the switching means 21. Y is determined in step S10 in FIG. 16, and the notification command 100 is output in step S14. The notification command 100 is input to the notification devices 3-1 to 3-n through the input/output I/F 13-02, the information/control-system cable 4, and the input/output I/Fs 13-12 to 13-n2 which are shown in FIG. 2, and input to the identification means 30-1 to 30-n in FIG. 13.

Figure 17:
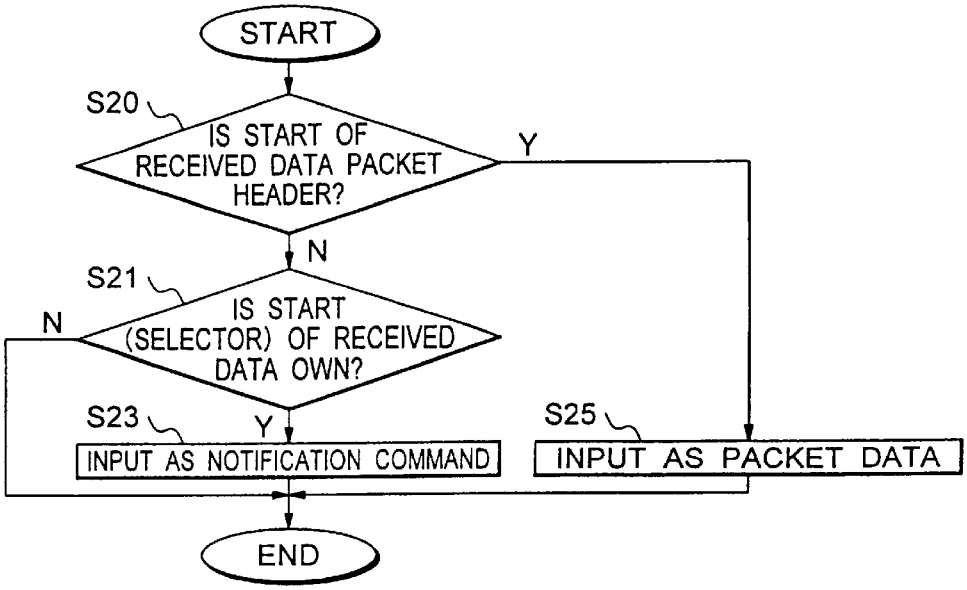
FIG. 17 is a flow chart showing the operation of a identification means of a notification device according to fourth embodiment of the present invention.

In the identification means 30-1 of the notification device 3-1, in FIG. 17, the start of received data is a packet header (N is set) in step S20, and the selector of the received data is of the identification means 30-1 (Y is set) in step S21. For this reason, "command 102=message display, data 103=3" of the second and subsequent bytes is input as a notification command in step S23. This notification command is given to the display means 32-1 in FIG. 13, "crowded" is displayed on a display 15-1. The notification devices 3-2 to 3-n of the elevator entrance receive the same notification command 100. However, N is determined in step S21 in FIG. 17, the notification devices 3-2 to 3-n neglect the notification command 100 without any operation.

A case in which the message number 3 of the notification device 3-1 of the cage is changed into "A person who lately got into, please get out of the cage" will be described below. In FIG. 13, notification data 200 representing "selector 210=cage, command 220=message updating, number 231=

3, text length 232=15 characters, text data 233=A person who lately got into, please get out of the cage" is given to the relay means 20 of the elevator control device 2.

Figure 15:
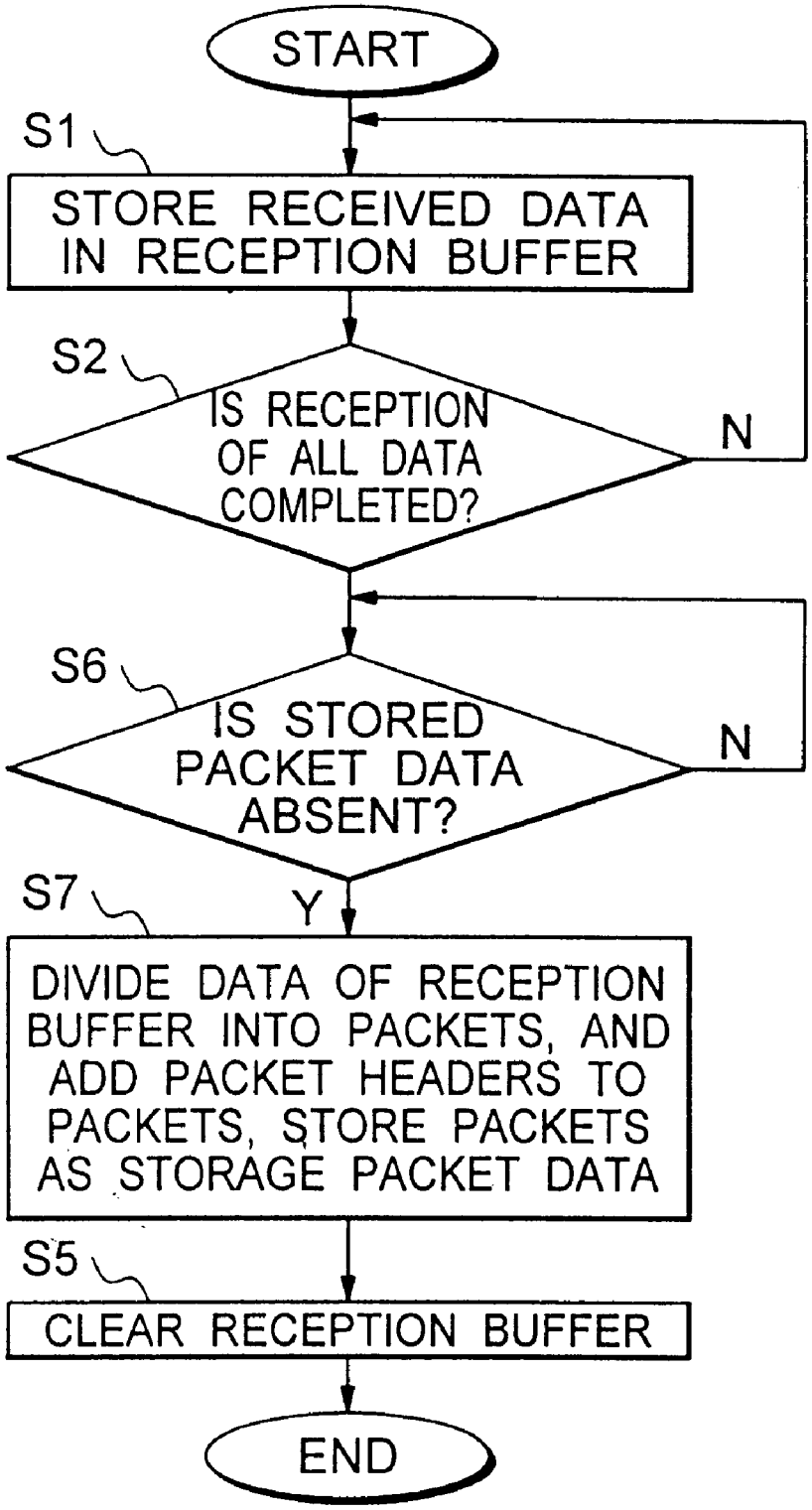
FIG. 15 is a flow chart showing the operation of a relay means of an elevator control device according to fourth embodiment of the present invention.

In the relay means 20, the received data is stored in a reception buffer (not especially shown) in step S1 in FIG. 15, and the completion of reception of all data is checked by the text length or the like in step S2. Upon completion of reception of all the data, the presence/absence of stored data is checked instep S6. If there is no stored data, the data in the reception buffer is divided into packets in step S7, packet headers are added to the packets, respectively, and the packets are stored in a memory (not especially shown) as storage packet data, and the reception buffer is cleared in step S5.

Figure 16:
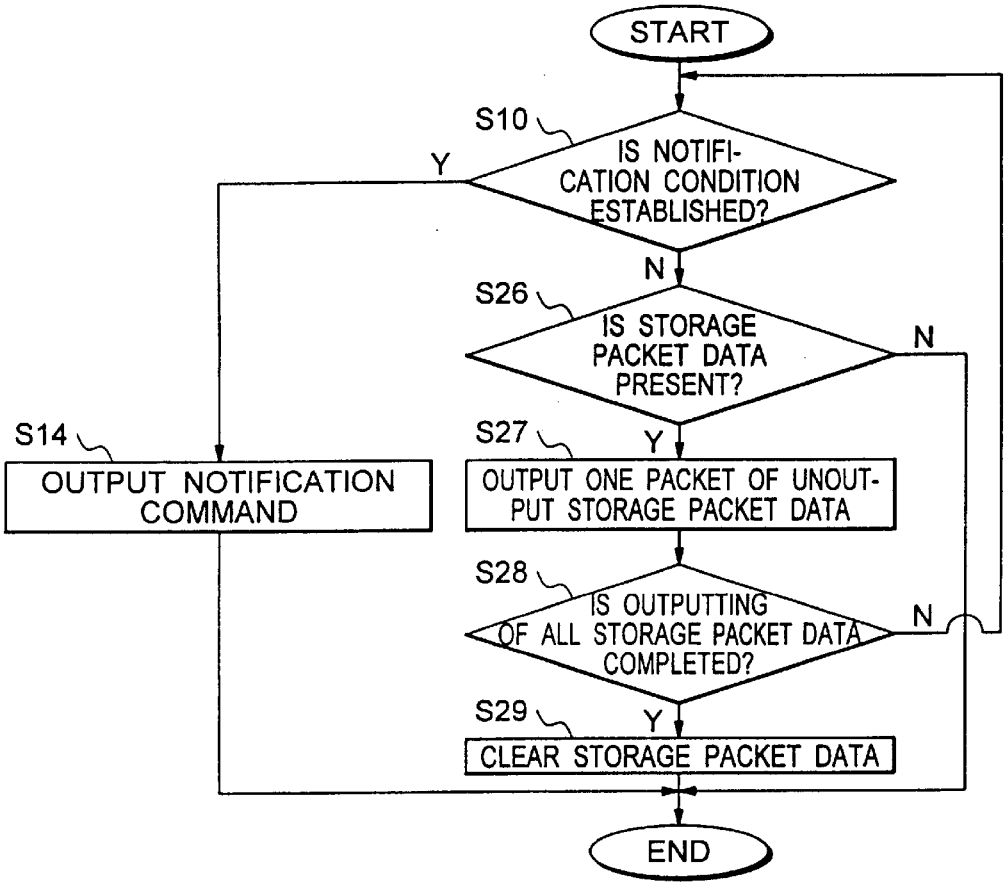
FIG. 16 is a flow chart showing the operation of a switching means of the elevator control device according to fourth embodiment of the present invention.

In the switching means 21, since N is determined in step S10, and Y is determined in step S27 in FIG. 16, one packet of unoutput stored packet data is output. Until Y is determined in step S28, N is determined in step S10, and Y is determined in step S26, and the process in step S27 is repeated. When all of stored packet data is output completely in step S28, the stored data is cleared in step S29.

In FIG. 2, the stored packet data outputed as described above is input to the notification devices 3-1 to 3-n through the input/output I/F 13-02, the information/control-system cable 4 and the input/output I/F 13-12 to 13-n2. Then, in FIG. 17, Y is determined in step S20, the stored packet data is input as the packet data, as is the case with the notification command 100. FIG. 14 shows the manner of the notification command 100 and the packet data which flow on the information/control-system cable 4 at once.

Figure 18:
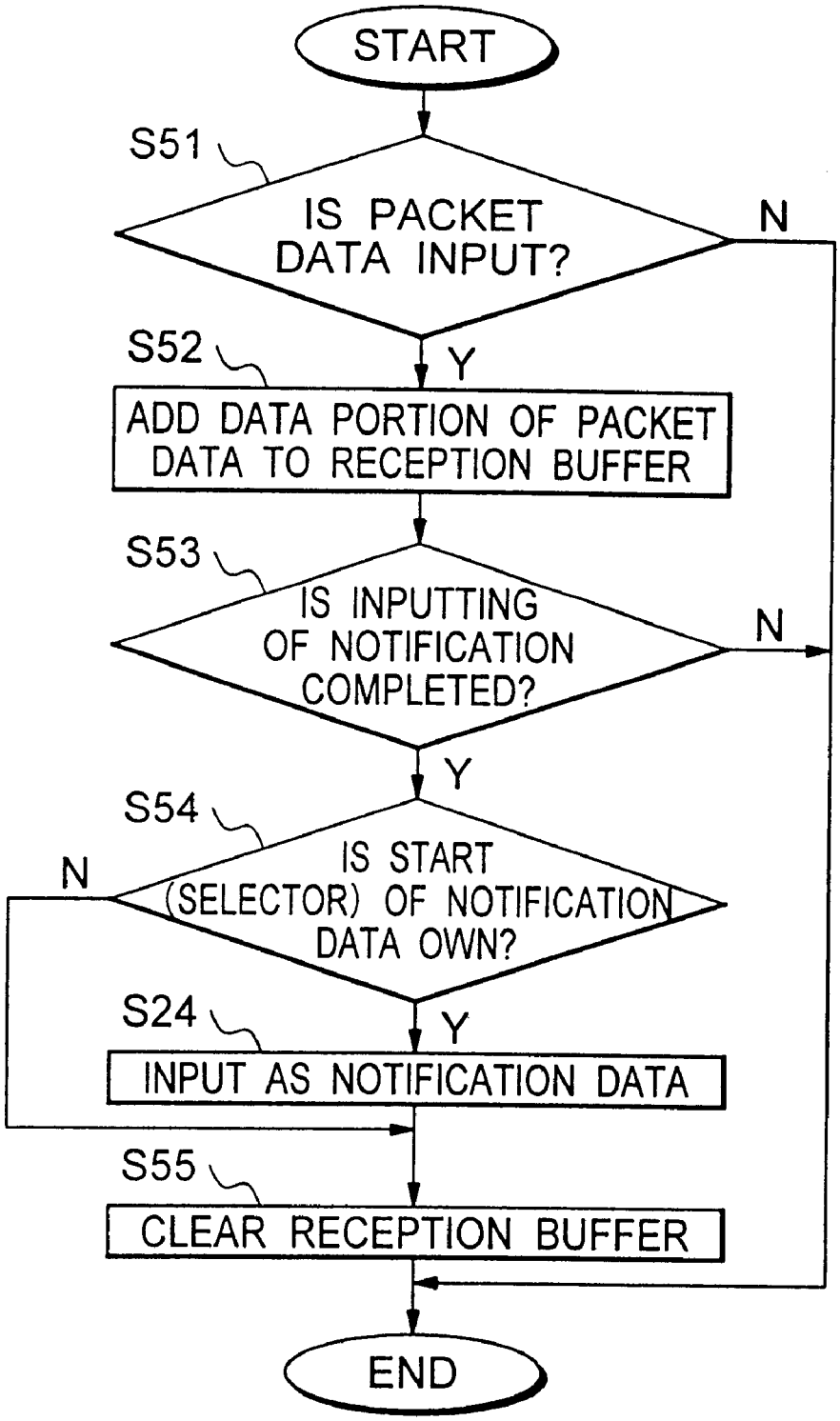
FIG. 18 is a flow chart showing the operation of a restoration means of the notification device according to fourth embodiment of the present invention.

In the restoration means 33-1 to 33-n, in FIG. 18, since Y is determined in step S51, the data portion of the packet data is added to a reception buffer (not especially shown) in step S52, and completion of notification data buffering (inputting) is checked by a text length or the like in step S53. Upon completion of the notification data buffering, in the restoration means 33-1 of the notification device 3-1, since Y is determined in step S54, data is input as notification data in step S24. The reception buffer is cleared in step S55.

As described above, in the elevator information communication system according to this embodiment, even if outputting of notification data is stopped by the command means such that notification data output from the elevator control device is divided into packets, restoration means for restoring the original notification data can be easily constituted in the notification device.

Fifth Embodiment

Figure 19:
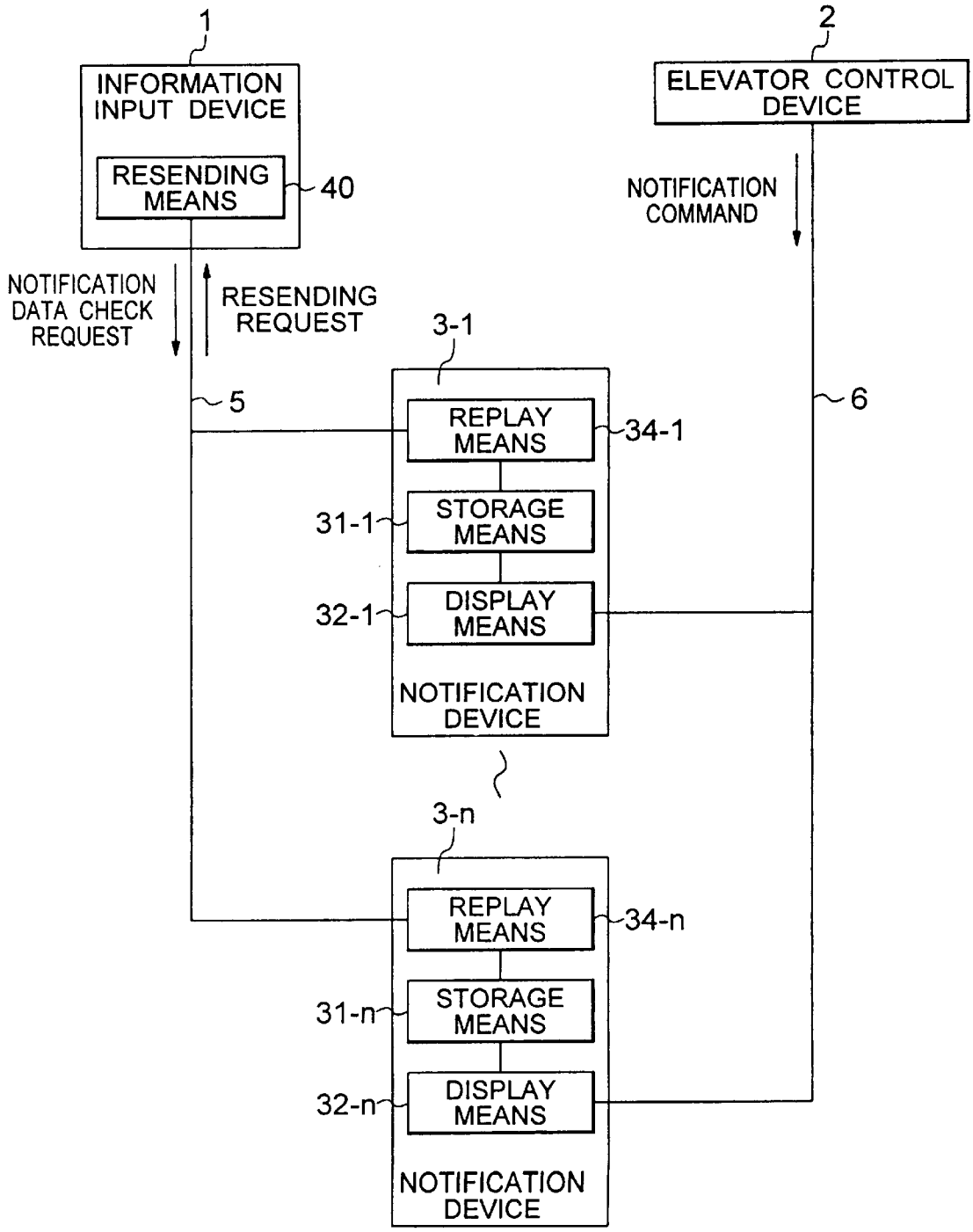
FIG. 19 is a block diagram showing the entire configuration of an elevator information communication system according to fifth embodiment of the present invention.
Figure 20:
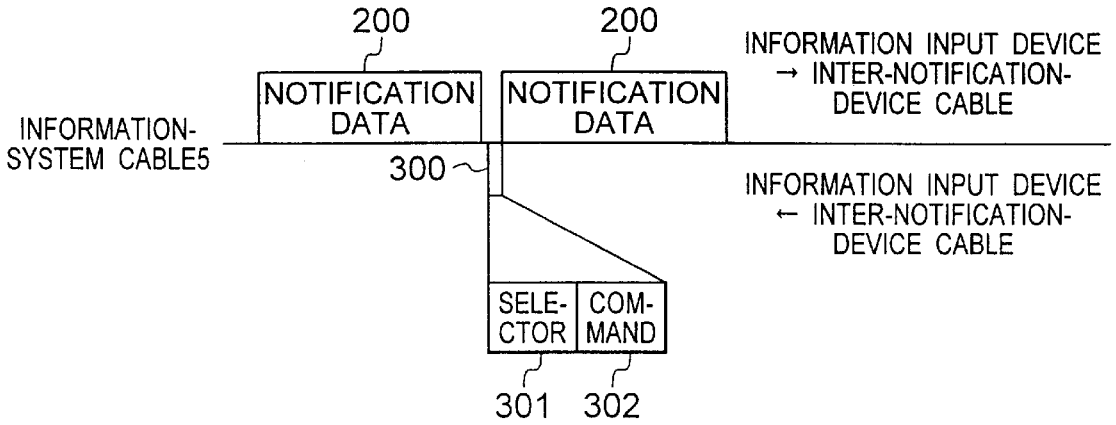
FIG. 20 is a time chart of communication path data of the elevator information communication system according to fifth embodiment of the present invention.
Figure 21:
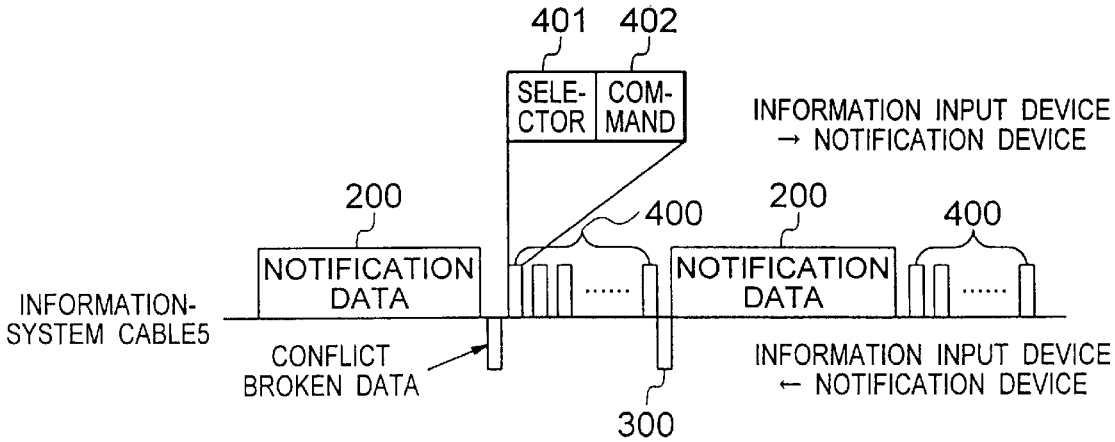
FIG. 21 is a time chart of the communication path data of the elevator information communication system according to fifth embodiment of the present invention.
Figure 22:
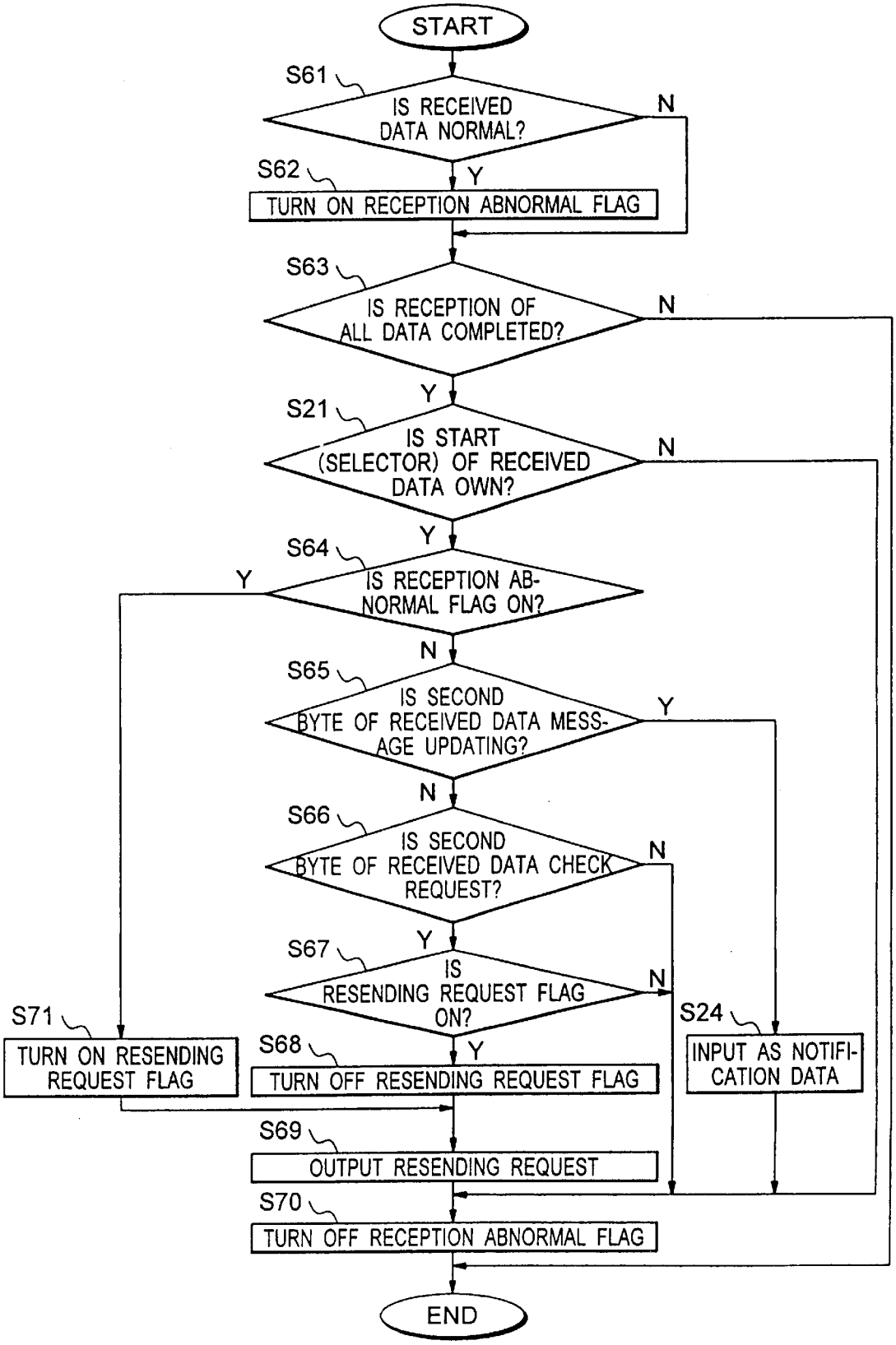
FIG. 22 is a flow chart showing the operation of a reply means of a notification device according to fifth embodiment of the present invention.
Figure 23:
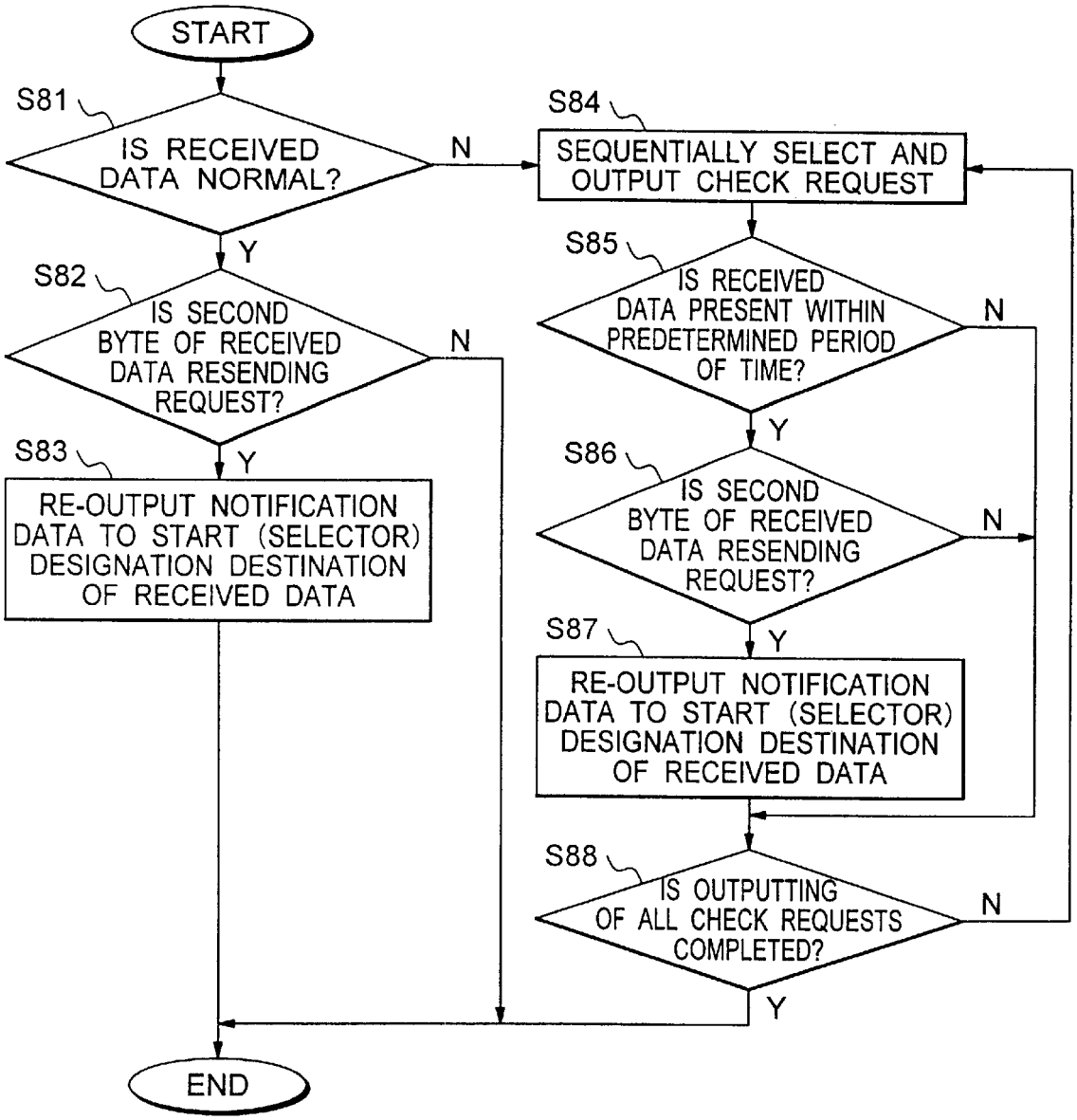
FIG. 23 is a flow chart showing the operation of a resending means of an information input device according to fifth embodiment of the present invention.

Fifth embodiment of the present invention will be described below with reference to FIGS. 19 to 23. FIG. 19 is a block diagram showing the entire configuration of an elevator information communication system, FIGS. 20 and 21 are time charts of communication path data, FIGS. 22 and 23 are flow charts showing the operation of reply means 34-1 to 34-n of notification devices 3-1 to 3-n and a resending means 40 of an information input device 1. In the following embodiment, an information-system cable 5 and a control-system cable 6 are independently arranged.

A case in which the message numbers 3 of all the notification devices 3-1 to 3-n are changed into "A person who lately got into, please get out of the cage" will be described below. In FIG. 19, notification data 200 representing "selector 210=all, command 220=message updating, number 231=3, text length 232 =15 characters, text data 233=A person who lately got into, please get out of the cage" is given to the reply means 34-1 to 34-n of the notification devices 3-1 to 3-n.

In the reply means 34-1 to 34-n, when communication is normally performed, in FIG. 22, Y is determined in steps S61, S63, and S21, N is determined in step S64, and Y is determined in step S65. For this reason, data is input as notification data in step S24. When communication is not normally performed, N is determined in step S61 in FIG. 22, and a reception abnormal flag is turned on in step S62 in FIG. 22. Upon completion of reception of all data, Y is determined in steps S63, S21, and S64, and a resending request flag is turned on in step S71. A resending request 300 (see FIG. 20) representing "selector 301=output source, command 302=resending request" is output, the reception abnormal flag is turned off in step S70.

In a normal state, since data are normally communicated to all the notification devices 3-1 to 3-n, any data is not returned to the information input device 1. For this reason, when transmission is performed once, the communication is completed. When communication is not normally performed in only one notification device, in this notification device, a resending request 300 is output in step S69 in FIG. 22 as described above. The resending request 300 is input to the resending means 40 of the information input device 1.

In the resending means 40, since Y is determined in step S81 and S82, notification data is re-output to only one notification device which performs abnormal communication in step S83. FIG. 20 shows a manner of the notification data 200 and the resending request 300 which flow on the information-system cable 5 at once. When communication is not normally performed in a plurality of notification devices, the plurality of notification devices output resending requests in step S69 in FIG. 22 as described above. For this reason, data on the information-system cable 5 conflict with each other to be broken (see FIG. 22).

The resending means 40 of the information input device 1 sequentially selects data in step S84 since N is determined in step S81, and the resending means 40 outputs a check request 400 representing "selector 401=output destination, command 402=resending request". A notification device which does not normally perform communication outputs a resending request 300 in step S69 in FIG. 22 as described above, and the resending means 40 of the information input device 1 determines Y in steps S85 and S86 in FIG. 23 and resends notification data to a start (selector) designation destination of the reception data. FIG. 21 shows a manner of the notification data 200, the resending request 300, and the check request 400 which flow on the information-system cable 5.

As described above, in the elevator information communication system according to this embodiment, since a resending request is made only when notification data input to the notification device is abnormal, the number of times of outputting of notification data can be set to be only one in a normal state. Even if a communication error is generated, notification data can be reliably transmitted.

Sixth Embodiment

Figure 24:
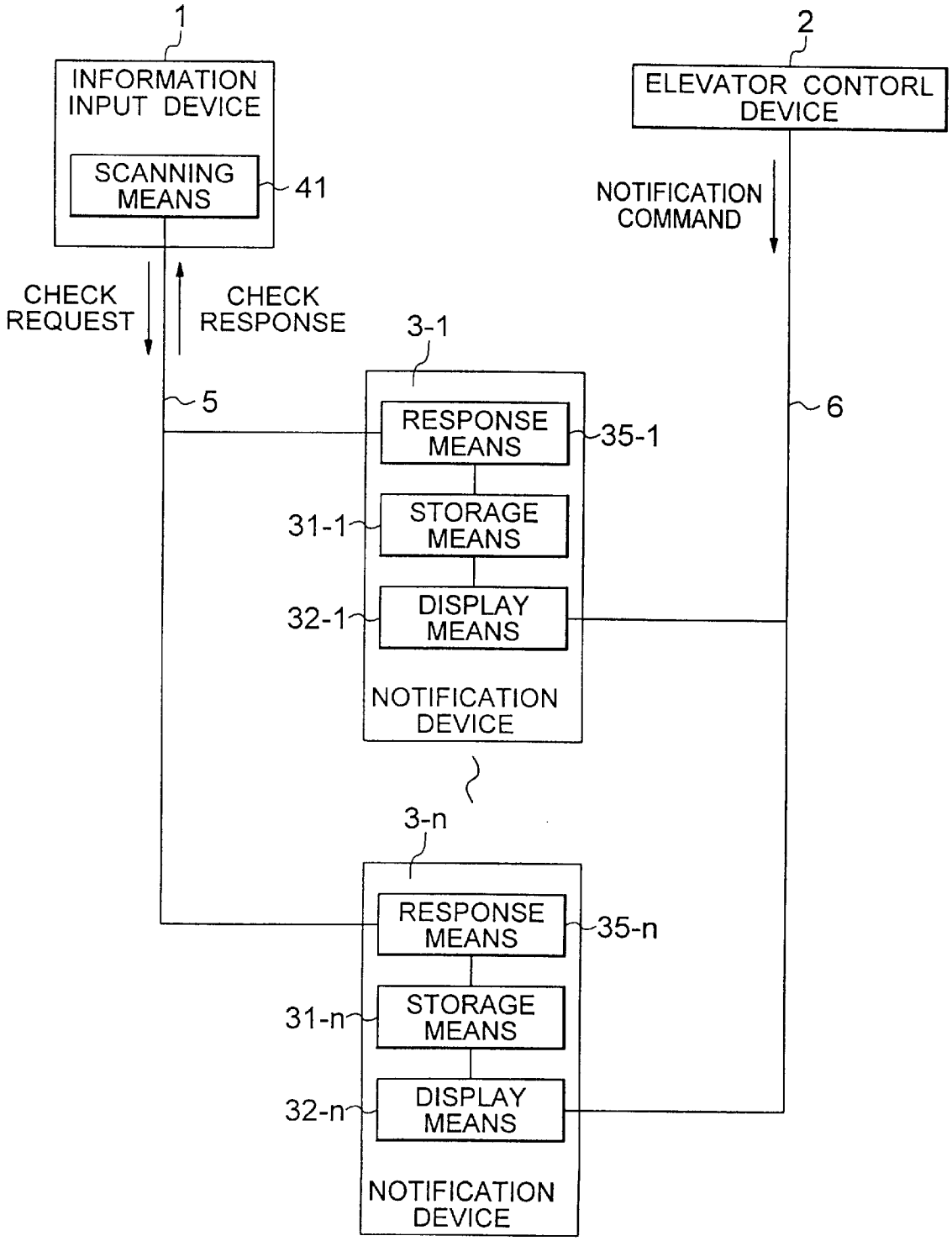
FIG. 24 is a block diagram showing the entire configuration of an elevator information communication system according to sixth embodiment of the present invention.
Figure 25:
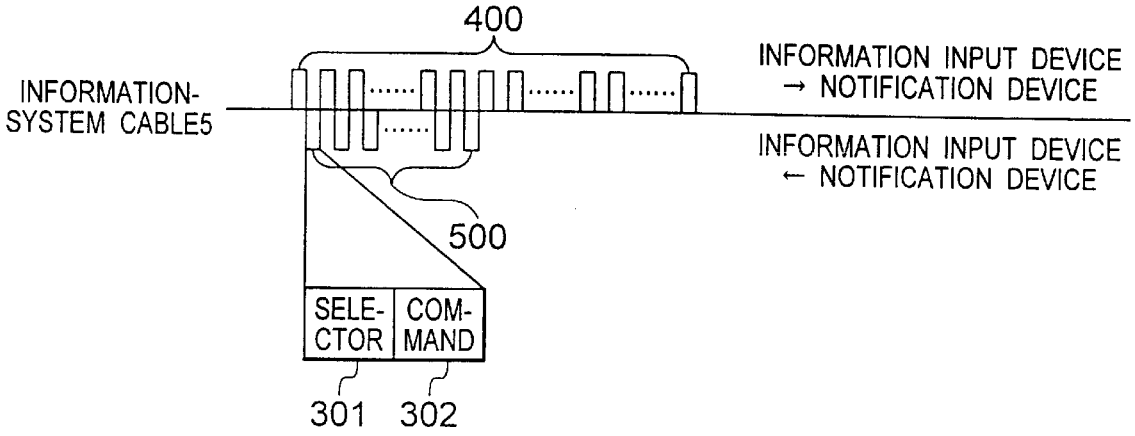
FIG. 25 is a time chart of communication path data of the elevator information communication system according to sixth embodiment of the present invention.

Sixth embodiment of the present invention will be described below with reference to FIGS. 24 to 27. FIG. 24 is a block diagram showing the entire configuration of an elevator information communication system, FIG. 25 is a time chart of communication path data, and FIGS. 26 and 27 are flow charts showing the operations of a scanning means 41 of an information input device 1 and response means 35-1 to 35-n of notification devices 31 to 3-n, respectively.

Figure 26:
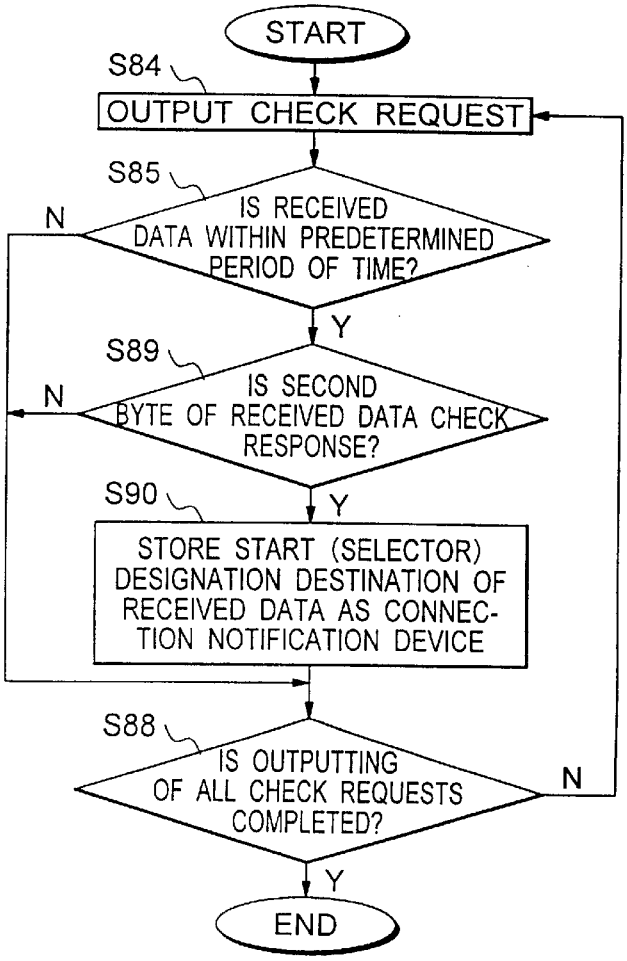
FIG. 26 is a flow chart showing the operation of a scanning means of an information input device according to sixth and seventh embodiments of the present invention.

When a predetermined condition is established in the information input device 1, the scanning means 41 outputs a check request 400 representing "selector 401=cage 1, command 402=check request" in step S84 in FIG. 26, and the check request 400 is given to the response means 35-1 to 35-n in FIG. 24.

Figure 27:
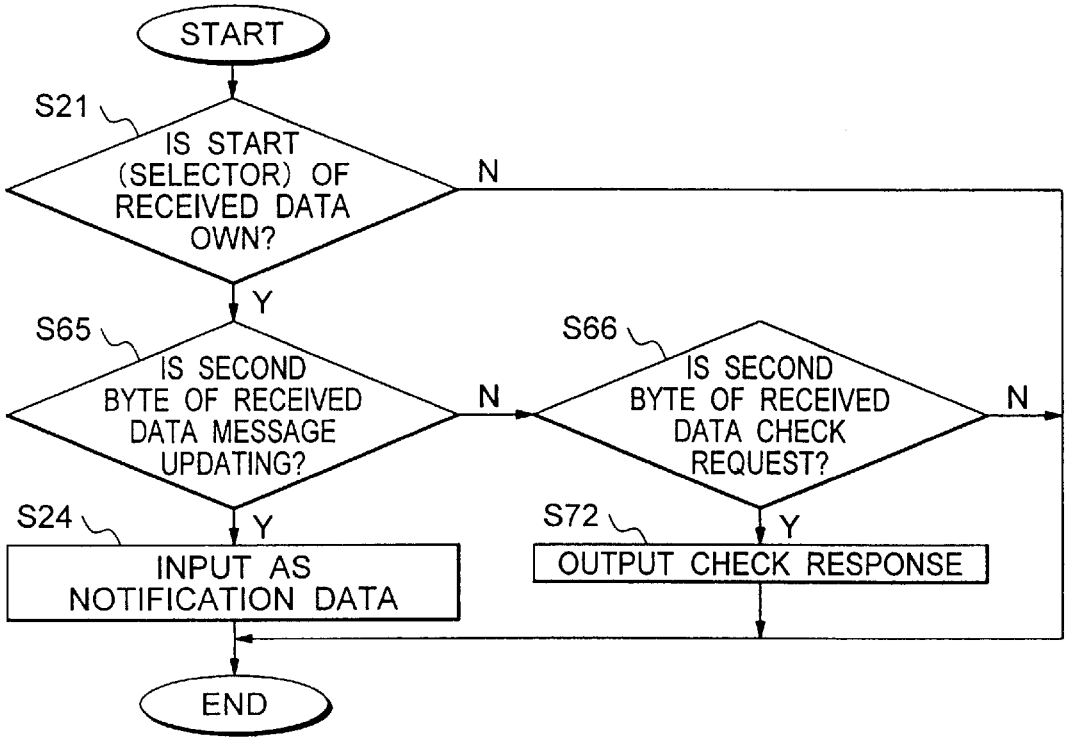
FIG. 27 is a flow chart showing the operation of a response means of a notification device according to sixth and seventh embodiments of the present invention.

In the response means 35-1 to 35-n, Y is determined (e.g., the response means 35-1 at the beginning) in step S21 in FIG. 27, N is determined in step S65, and Y is determined in step S66. For this reason, a check response 500 representing "selector 501=cage 1, command 502=check response" is output in step S72, and the check response 500 is given to the scanning means 41 in FIG. 24.

In the scanning means 41, when Y is determined in steps S85 and S89 in FIG. 26, cage 1 is stored as a connection notification device in step S90. The processes in steps S84, S85, S89, and S90 are repeated until the check request 400 is output to all the notification devices 3-1 to 3-n, and Y is determined in step S88 to end the processes. FIG. 25 shows a manner of the check request 400 and the check response 500 which flow on a information-system cable 5.

In the elevator information communication system according to this embodiment, when notification devices include a notification device which is in an OFF state or is broken, the notification devices are scanned by the scanning means of the information input device one by one to check the OFF notification device or broken notification device, thereby automatically detect the OFF notification device or the broken notification device.

Seventh Embodiment

Figure 28:
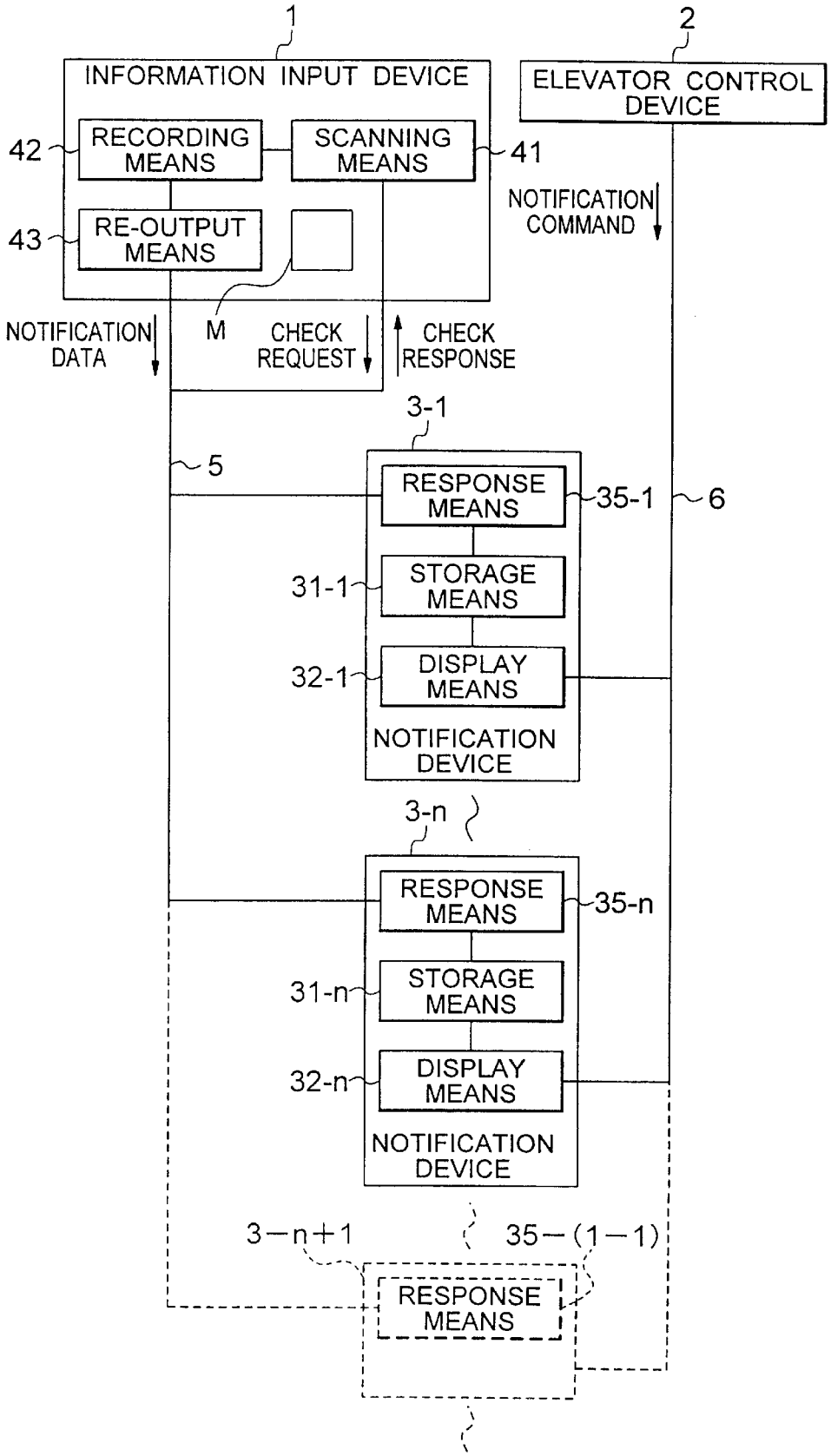
FIG. 28 is a block diagram showing the entire configuration of an elevator information communication system according to seventh embodiment of the present invention.
Figure 29:
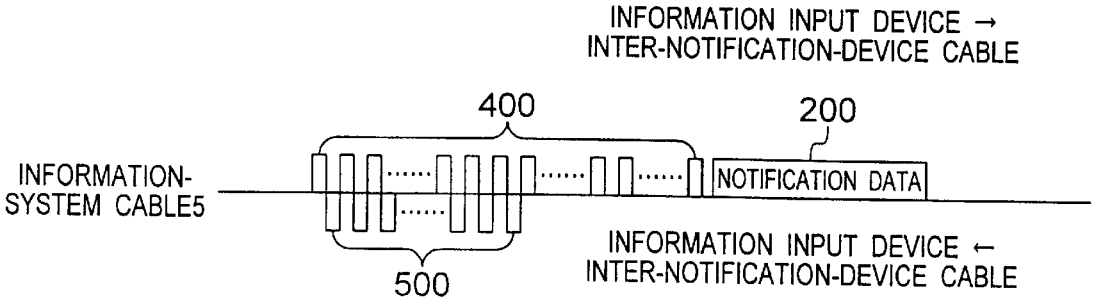
FIG. 29 is a time chart of communication path data of the elevator information communication system according to seventh embodiment of the present invention.
Figure 30:
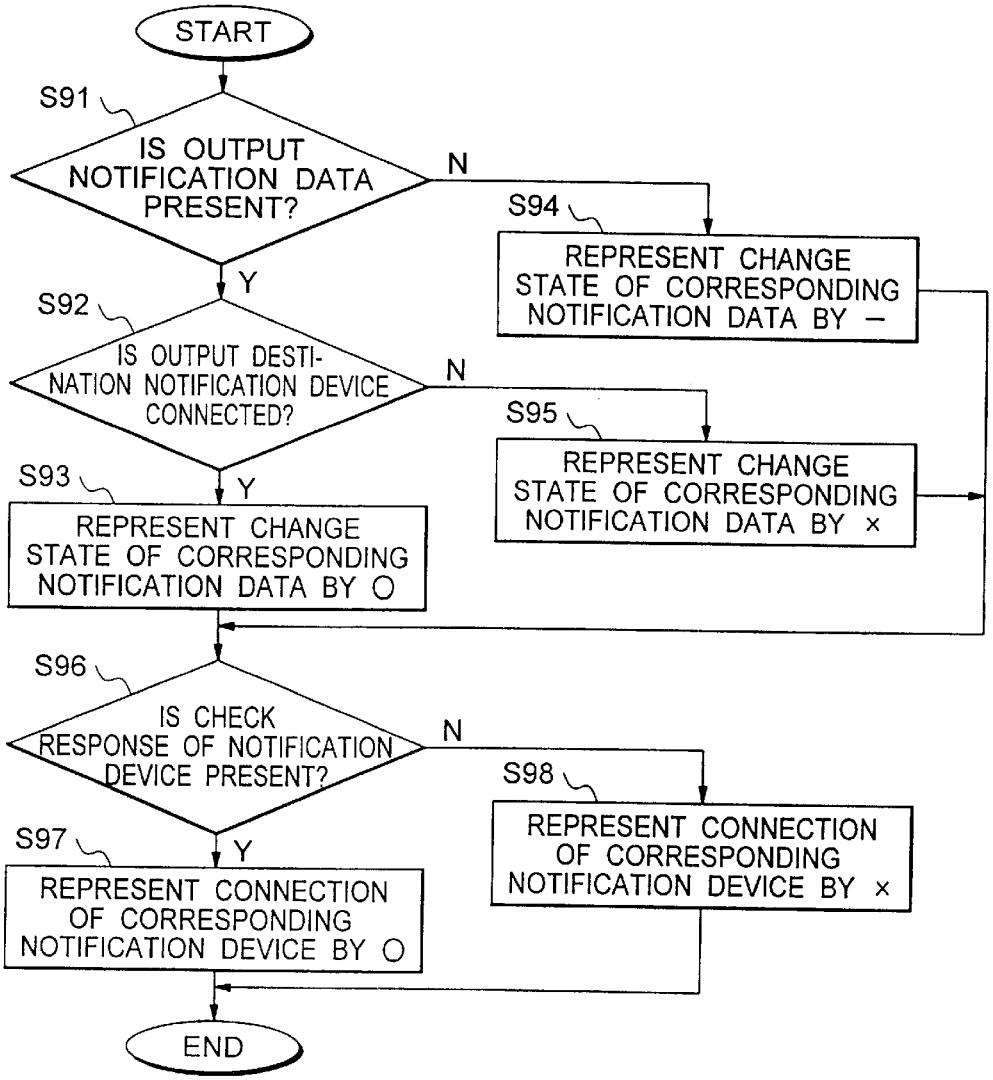
FIG. 30 is a flow chart showing the operation of a recording means of an information input device according to seventh embodiment of the present invention.
Figure 31:
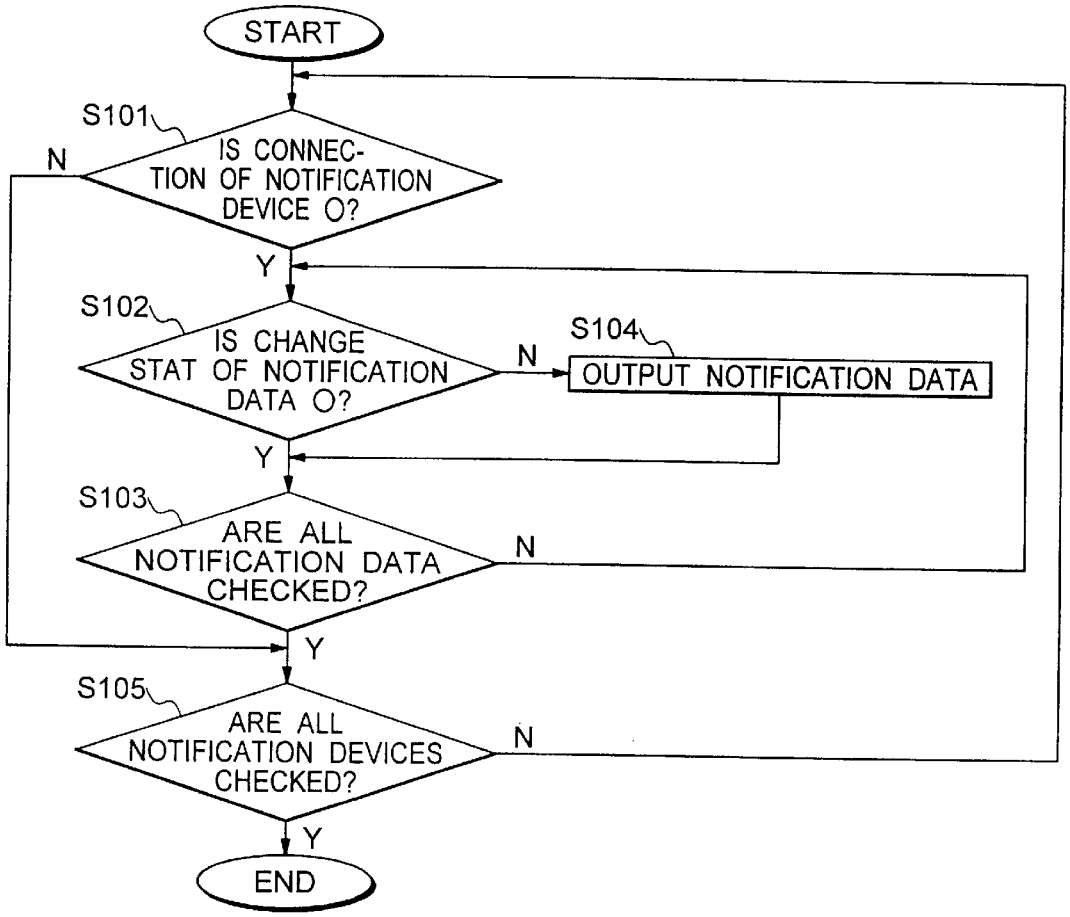
FIG. 31 is a flow chart showing the operation of a re-output means of the information input device according to seventh embodiment.
Figure 33:
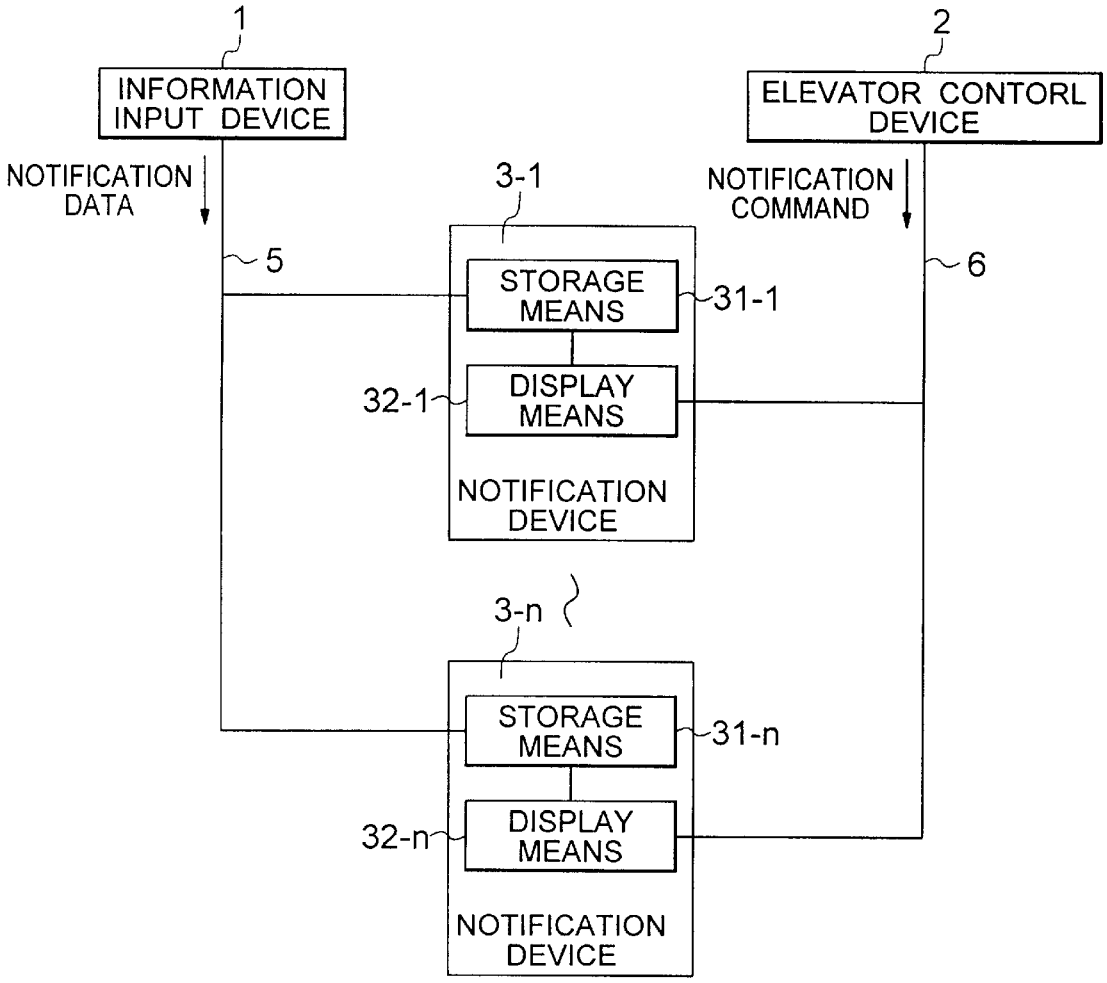
FIG. 33 is a block diagram showing the entire configuration of a conventional elevator information communication system.

Seventh embodiment of the present invention will be described below with reference to FIGS. 28 to 32. FIG. 28 is a block diagram showing the entire configuration of an elevator information communication system, FIG. 29 is a time chart of communication path data, and FIGS. 30 and 31 are flow charts showing a recording means 42 and a re-output means 43 of the information input device 1, respectively. FIG. 32 shows tables of notification data output records M of an information input device.

A case in which notification data representing "selector 210=all elevator entrances, command 220=message updating, number 231=1 text length 232=15 characters, text data 233=A person who lately got into, please get out of the cage" is output, and an entrance notification device 1 (el) is newly additionally installed will be described below.

Transmission and return (see FIG. 29) of the check request 400 and the check response 500 between the scanning means 41 and the response means 35-1 to 35-n in FIG. 28 are the same as those in sixth embodiment (see FIG. 25), and a description thereof will be omitted. Before the entrance notification device 1 (el) is installed, in the recording means 42, Y is set in step S91 in FIG. 30, and N is set in step S95 in FIG. 30. For this reason, a change state of notification data is represented by x in step S95. Since N is determined in step S96, connection of a notification device is represented by x (see FIG. 32).

After the entrance notification device 1 (el) is newly installed, Y is determined in step S91 in FIG. 30, and N is determined in step S95 in FIG. 30. For this reason, a change state of notification data is represented by x instep S95. Since Y is determined in step S96, connection of the entrance notification device 1 (el) newly installed is represented by o (see FIG. 32).

In the re-output means 43, since Y is determined in step S101 in FIG. 31, and N is determined in step S102 in FIG. 31, the notification data 200 is output in step S104. The notification data is input to a response means 35-(1-1) in FIG. 28, and the data is input as notification data in the response means 35-(1-1) in step S24 because Y is set in steps S21 and S65 in FIG. 27 (see sixth embodiment). The change state of the notification data of the entrance notification device 1 (el) is represented by o in the processes of the recording means 42 in FIG. 30 when the next notification data is output.

FIG. 29 shows the notification data 200, the check request 400, and the check response 500 which flow on the information-system cable 5. FIG. 32 shows notification data output records M stored in the information input device 1, and, more particularly, a change in record before and after the entrance notification device 1 (el) is newly installed.

As described above, in the elevator information communication system according to this embodiment, when a notification device is added sometime, the added notification device is detected by the scanning means of the information input device, and un-output notification data is output by the reoutput means. For this reason, notification data required for the added notification device can be automatically set.

In each of the inventions of fifth to seventh embodiments described above, one cable to each notification device is arranged as in each of first to fourth embodiments, transmission/reception can be performed. In addition, the inventions of the embodiments described above can be appropriately combined to each other as needed.

As has been described above, according to the first aspect of the present invention, there is provided an elevator information communication system including a notification device arranged in the elevator system, an information input device for forming notification data to the notification device to input the notification data, and an elevator control device connected to the notification device to output a notification command and having relay means connected to the information input device to relay the notification data input from the information input device to the notification device. For this reason, the notification data transmitted from the information input device to the notification device is relayed by the relay means arranged in the elevator control device, so that a dedicated information-system cable for connecting the information input device and the notification device to each other is not necessary. A simple configuration can be obtained, and a system which can efficiently perform communication at a low cost can be provided.

According to the second aspect of the present invention, there is provided an elevator information communication system wherein the elevator control device includes switching means for adding non-transmission time and identification data to data and outputting the data in order to identify a notification command from the elevator control device and the notification data from the information input device by the information device. For this reason, since the non-transmission time and the identification data are added when the notification command and the notification data transmitted to the notification device are switched to each other, identification can be performed by the notification device.

According to the third aspect of the present invention, there is provided an elevator information communication system wherein the elevator device includes command means for, when a notification command is generated during outputting of notification data from the information input means, interrupting the outputting of the notification data. For this reason, when the notification command is present during outputting of the notification data from the elevator control device, the outputting of the notification data is stopped by the command means to output the notification command, so that the outputting of the notification command can be prevented from being delayed.

According to the fourth aspect of the present invention, there is provided an elevator information communication system wherein the elevator control device changes notification data into a packet to output the packet, and the notification device includes restoration means for restoring interrupted notification data into original notification data. For this reason, when the notification data output from the elevator control device is changed into a packet to stop outputting of the notification data, the notification data can be easily restored into the original notification data by the notification device.

According to the fifth and eighth aspects of the present invention, there is provided an elevator information communication system wherein the notification device includes reply means for generating a resending request when input notification data is abnormal, and the information input device includes resending means for resending the notification data according to the resending request. For this reason, the number of times of outputting of notification data can be set to be one in a normal state, and the notification can be reliably transmitted if a communication error is generated.

According to the sixth and ninth aspects of the present invention, there is provided an elevator information communication system wherein the information input device includes scanning means for checking a notification device which is powered off and broken, and the notification device includes response means for making a check response to the check. For this reason, when notification devices include a notification device which is in an OFF state or is broken, the notification devices are scanned by the scanning means of the information input device one by one to check the OFF notification device or broken notification device, thereby automatically detect the OFF notification device or the broken notification device.

According to the seventh and tenth aspects of the present invention, there is provided an elevator information communication system wherein the information input device detects the notification device added by the scanning means, and includes re-output means for further outputting un-output notification data to set necessary notification data in the added notification device. For this reason, when a notification device is added sometime, the added notification device is detected by the scanning means of the information input device, and un-output notification data is output by the re-output means. For this reason, notification data required for the added notification device can be automatically set.

What is claimed is:

1. An elevator information communication system comprising:

a notification device in an elevator system for supplying information to an elevator user;

an information input device for supplying notification data to the notification device for supplying the information to the elevator user; and an elevator control device connected to the notification device and outputting notification commands to the notification device for controlling the elevator system and having relay means connected to the information input device to relay the notification data received from the information input device to the notification device, and a switch connected between the relay means and the notification device and receiving the notification commands, for controlling transmission of the notification commands and the notification data to the notification device, wherein, if a notification command is received by the switch when notification data is being transmitted to the notification device, the switch delays transmission of the notification command until completion of transmission of the notification data.

2. The elevator information communication system according to claim 1, wherein the switch inserts a delay of a non-transmission time and adds identification data to the notification data, and outputs the notification data with the identification data added, to distinguish a notification command, and a notification data supplied through the information input device.

3. The elevator information communication system according to claim 1, including a plurality of notification devices and a single control system cable connecting the notification devices to the elevator control device whereby the information input device can selectively communicate with the respective notification devices through a single transmission cable.

4. The elevator information communication system according to claim 3, wherein each notification device includes identification means for identifying notification data and notification commands directed to the respective notification device and display means for displaying the notification data.

* * * * *